US008493302B2

(12) United States Patent
Sekine

(10) Patent No.: US 8,493,302 B2
(45) **Date of Patent: *Jul. 23, 2013**

(54) LIQUID CRYSTAL DISPLAY DEVICE WITH CORRECTION VOLTAGE DIFFERENT FROM VIDEO SIGNAL APPLIED TO DATA LINE IN DISPLAY PERIOD

(75) Inventor: Hiroyuki Sekine, Kanagawa (JP)

(73) Assignee: NLT Technologies, Ltd., Kanagawa (JP)

( * ) Notice: Subject to any disclaimer, the term of this patent is extended or adjusted under 35 U.S.C. 154(b) by 793 days.

This patent is subject to a terminal disclaimer.

(21) Appl. No.: 12/052,772

(22) Filed: Mar. 21, 2008

(65) Prior Publication Data

US 2008/0239180 A1 Oct. 2, 2008

(30) Foreign Application Priority Data

Mar. 29, 2007 (JP) ..... 2007-086189
Mar. 7, 2008 (JP) ..... 2008-057376

(51) Int. Cl.
*G09G 3/36* (2006.01)

(52) U.S. Cl.
USPC ..... 345/87; 345/88; 345/89; 345/90; 345/91; 345/92; 345/93; 345/94; 345/95; 345/96; 345/97; 345/98; 345/99; 345/100; 345/101; 345/102; 345/103; 345/104

(58) Field of Classification Search
USPC ..... 345/87–104
See application file for complete search history.

(56) References Cited

U.S. PATENT DOCUMENTS

| | | | | |
|---|---|---|---|---|
| 5,841,410 | A * | 11/1998 | Oda et al. | 345/58 |
| 5,920,298 | A | 7/1999 | McKnight | |
| 6,570,554 | B1 * | 5/2003 | Makino et al. | 345/102 |
| 6,980,273 | B2 * | 12/2005 | Ota et al. | 349/141 |
| 7,184,018 | B2 * | 2/2007 | Makino et al. | 345/102 |
| 2005/0168665 | A1 * | 8/2005 | Ina et al. | 349/42 |
| 2005/0225630 | A1 * | 10/2005 | Childers et al. | 348/51 |
| 2006/0077116 | A1 * | 4/2006 | Chen et al. | 345/1.1 |

FOREIGN PATENT DOCUMENTS

| | | | |
|---|---|---|---|
| CN | 1499456 | A * | 5/2004 |
| CN | 1514427 | A * | 7/2004 |
| CN | 1573451 | A * | 2/2005 |
| CN | 1584661 | A * | 2/2005 |

(Continued)

OTHER PUBLICATIONS

Office Action dated Aug. 8, 2012, issued by the Japanese Patent Office in counterpart Japanese Application No. 2008-057376.

(Continued)

*Primary Examiner* — Alexander S Beck
*Assistant Examiner* — Karin Kiyabu
(74) *Attorney, Agent, or Firm* — Sughrue Mion, PLLC

(57) ABSTRACT

The present invention aims to reduce flickers of the liquid crystal display device and enable the use of liquid crystal material exhibiting a high response speed, and to enhance light usage efficiency of the field sequential type liquid crystal display device. After writing the video signal to all the pixels in each sub-frame period, a correction voltage signal or an alternating signal having a frequency of greater than or equal to a certain frequency is input to the data line, so that the magnitude of the leakage current of each pixel TFT caused by the difference in polarity of the video signal with respect to the opposing electrode written to the pixel electrode is equalized, and the flickers are greatly reduced.

21 Claims, 33 Drawing Sheets

FOREIGN PATENT DOCUMENTS

| | | | | |
|---|---|---|---|---|
| CN | 1707597 | A | * | 12/2005 |
| JP | 05313607 | A | | 11/1993 |
| JP | 11231843 | A | | 8/1999 |
| JP | 2001-66547 | A | | 3/2001 |
| JP | 2001-272651 | A | | 10/2001 |
| JP | 2001318363 | A | * | 11/2001 |
| JP | 2002-287163 | A | | 10/2002 |
| JP | 2005-24737 | A | | 1/2005 |
| JP | 2005-215341 | A | | 8/2005 |

OTHER PUBLICATIONS

Japanese Office Action dated Oct. 30, 2012 issued by the Japanese Patent Office in corresponding Japanese Patent Application No. 2008-057376.

* cited by examiner

LIQUID CRYSTAL DISPLAY DEVICE WITH CORRECTION VOLTAGE DIFFERENT FROM VIDEO SIGNAL APPLIED TO DATA LINE IN DISPLAY PERIOD

CROSS-REFERENCE TO RELATED APPLICATION

This application is based upon and claims the benefit of priority from Japanese patent application No. 2007-086189, filed on Mar. 29, 2007, and Japanese patent application No. 2008-057376, filed on Mar. 7, 2008, the disclosure of which is incorporated herein in its entirety by reference.

BACKGROUND OF THE INVENTION

1. Field of the Invention

The present invention relates to liquid crystal display devices, portable terminal devices and projector devices using the same, and methods and programs for driving the liquid crystal display device, in particular, to a field sequential type active matrix liquid crystal display device, a portable terminal device and a projector device using the same, and a method and a program for driving the liquid crystal display device.

2. Description of the Related Art

Active matrix type liquid crystal display devices including thin film transistors (TFT) at each of the pixels are capable of displaying videos with high picture qualities, so that many of such type of display devices are used for thin-type television sets, displays for portable terminal devices, projector light valves, etc. Such liquid crystal display device used for thin type television sets and portable terminal devices normally has such a structure that is shown in FIG. 31. In this liquid crystal display device, for displaying a color image, one pixel is divided into three sub-pixels, and color filters of red (R) 91, green (G) 92, and blue (B) 93 are provided to the sub-pixels, respectively. Gate line 97 are scanned by a gate driver 94, and video signals are supplied to data lines 98 by a data driver 95 to select pixels so as to drive corresponding liquid crystals to achieve a color display.

In the meantime, a light valve used for a liquid crystal projector has a structure where each pixel is formed as a single piece as shown in FIG. 30. There is no color filter provided in the liquid crystal display device that configures this light valve, and a single pixel is not divided into a plurality of sub-pixels, either. This is because, in a typical projector, three light valves of red (R), green (G), and blue (B) are used for corresponding to light of three primary colors, gate lines 87 are scanned by a gate driver 84, and video signals are supplied to a data line 88 by a data driver 85 to drive the liquid crystals of each pixel.

It is necessary to divide a single pixel into three sub-pixels in the liquid crystal display device which performs color displays by using the color filters, as it is described earlier by referring to FIG. 31. Thus, when the resolution of the liquid crystal display device is increased, the areas of each of the sub-pixels become reduced. This leads to reduction of the numerical aperture, which results in causing light loss. Further, the three-plate type liquid crystal projector shown in FIG. 30 requires three light valves, so that the cost thereof becomes high and the device cannot be formed small in size.

As a measure for overcoming such issues, there is a field sequential type liquid crystal display device as described in U.S. Pat. No. 5,920,298 (FIG. 8) (patent document 1). The field sequential type is a system which divides the time for a liquid crystal display device to display a video of one screen into three periods, displays videos corresponding to colors of red (R), green (G), and blue (B) in each period, and switches the colors of the light irradiated to the liquid crystal display device by synchronizing with the videos to achieve a color display. As described above, the field sequential type which performs color display by switching the color of the light source, without dividing each pixel of the liquid crystal display device into sub-pixels of red (R), green (G), and blue (B), can realize a liquid crystal display device having improved light utilizing efficiency, since color filters are not used and the numerical aperture of the pixel can be designed large.

FIG. 29 shows one example of a configuration of the field sequential type liquid crystal display device. This liquid crystal display device is configured with a back light (BL) 104 that can switch the color of light to be irradiated to a display device body 103 to red (R), green (G), and blue (B); a display device body 103; a control circuit 102 for controlling the display device body 103 and the back light 104; and a signal source 101. FIG. 32 shows one example of a configuration of the display device body used in such system. The display device body includes: a pixel matrix in which pixels each including a pixel TFT, a pixel capacitance and an accumulative capacitance are disposed in matrix at each intersection point of the data lines 118 and the gate lines 117 arranged vertically and laterally; and a data driver circuit 115 disposed in the periphery of the pixel matrix for driving the data lines 118 as well as a gate driver circuit 114 disposed in the periphery for driving the gate lines 117.

Actions of the field sequential type liquid crystal display device will be described by referring to a timing chart of FIG. 33. A frame period Tf during which a video for one screen is displayed in the liquid crystal display device is divided into three sub-frame periods Tsf_r, Tsf_g, and Tsf_b. In the sub-frame period Tsf_r, executed is an action for displaying a video of red (R) at each pixel of the liquid crystal display. First, a gate line G1 is set to high level. Synchronously with this, a video signal is written to the data lines D1-D10. Thereby, the video signal is written to each pixel on a pixel row that is connected to the gate line G1. By performing this action for all the gate lines G1-G8, the video signal of red (R) is written to all the pixels.

After writing the video signal of red (R) to all the pixels, the light source of red (R) is lighted up after a passage of a certain waiting period. With this, the liquid crystal display device displays a video of red (R) among a color video. LED R herein indicates a control signal for lighting up the light source of red (R). In the same manner, a video of green (G) is displayed in Tsf_g, and a video of blue (B) is displayed in Tsf_b. Thereby, observers mix the colors of those videos in terms of time to recognize it as a color video.

However, unless the response speed of the liquid crystal is extremely high in the field sequential type, luminance unevenness and lowering in luminance occurs in the screen. The reasons for the cause of such problem will be described below.

Regarding T1 and T8 in FIG. 33, T1 shows changes in the transmittance of the pixels that are connected to the gate line G1, and T8 shows changes in the transmittance of the pixels that are connected to the gate line G8. If the waiting period is too short and the light source is lighted up while the transmittance change of T8 is still continuing, there is a difference generated between the luminance within a screen even though the same luminance is to be displayed on the entire screen. Meanwhile, if the waiting period is set too long, the light-up time of the light source becomes too short, thereby resulting in providing a dark display. Therefore, it is necessary for the field sequential type liquid crystal display device to use a liquid crystal material that is capable of enabling sufficient response within a sub-frame period and capable of operating at a very high speed, that is, at a response speed of the liquid crystal of lower than or equal to a few ms.

As a measure for solving such problem, a method of applying a voltage, which applies a large electric field to the liquid crystal, to counter electrodes during the period of writing the video signal for one screen to the liquid crystal display device, and changing the voltage of the counter electrodes after completing the writing to simultaneously change the liquid crystals of all the pixels of the liquid crystal display device to the state corresponding to the video signal thereby eliminating the luminance difference in the screen is proposed from Macknight (patent document 1).

SUMMARY OF THE INVENTION

However, problems that degrade the displaying image quality of the liquid crystal display device exist even if the driving method proposed in patent document 1 is adopted. The problem includes flickers (flickering of screen) that tend to easily occur. Flickers occur when a difference is created in frame unit in the fluctuating amount of the video signal voltage held at the pixel. Such voltage fluctuation mainly occurs by leakage current of the pixel TFT, where the leakage current of the TFT changes with the source-drain voltage and at the source-gate voltage of the pixel TFT. Assuming the terminal connected to the data line of the pixel TFT is the source and the terminal connected to the pixel electrode is the drain, it is found through experiment that the leakage current becomes the largest when the source-drain voltage is large and the source-gate voltage is small.

In the method proposed in patent document 1, the polarities of video signals written to all the pixels of the pixel matrix with respect to the counter electrode are required to be the same for each of the sub-frame periods. Thus, the magnitude of the leakage current changes due to the leakage characteristic of the TFT between when the video signal of positive polarity with respect to the counter electrode is written and when the video signal of negative polarity is written, and as a result, a difference is created in the fluctuation amount of the voltage held at the pixel. This is the cause of flickers.

With respect to such problem, a pre-charge operation of writing voltage that has no correlation with the video signal to the data line for every one horizontal period of writing the video signal to one pixel row of the liquid crystal display device is proposed. However, in the field sequential type liquid crystal display device, the time necessary for the write of the video signal increases and lowering in luminance occurs if the pre-charge operation is performed.

An exemplary object of the present invention is to improve the picture quality of a field sequential type liquid crystal display device by reducing flickers of a liquid crystal display device that uses liquid crystal molecules exhibiting a high response speed, and to provide a liquid crystal display device in which the light utilizing efficiency is improved dramatically.

It is an exemplary object of the present invention to reduce flickers of the liquid crystal display device using liquid crystal molecules exhibiting a high response speed, to improve the image quality of the liquid crystal display device of the field sequential method, and to greatly enhance the light usage efficiency of the liquid crystal display device.

In order to achieve the foregoing exemplary object, a liquid crystal display device according to an exemplary aspect of the invention includes: a display panel including a pixel matrix in which pixels each including at least a switching element and a pixel electrode are arranged in matrix near intersection points of data lines and gate lines arranged longitudinally and laterally, and a counter electrode that is arranged to oppose the pixel matrix with a liquid crystal layer interposed therebetween; a light source for irradiating light onto the display panel; and a control part for dividing a frame period for displaying a video signal of one screen into a plurality of sub-frame periods and performing display on the display panel; wherein the control part divides each of the sub-frame periods into a writing period for writing the video signal to the pixel matrix and a display period for lighting up the light source, and applies a correction voltage that is different from the video signal to the data line in the display period.

While the present invention is built as a liquid crystal display device, as hardware, but is not limited only to that. The present invention may also be built as a control system, and a control program or a driving method, as software.

When the present invention is built as a control system, it is structured as follows. That is, the control system according to another exemplary aspect of the invention is structured as a control system for drive-controlling a display panel that includes: a pixel matrix in which pixels each including at least a switching element and a pixel electrode are arranged in matrix near intersection points of data lines and gate lines arranged longitudinally and laterally, and a counter electrode that is arranged to oppose the pixel matrix with a liquid crystal layer interposed therebetween. The control system includes a light source for irradiating light onto the display panel and a control part for dividing a frame period for displaying a video signal of one screen into a plurality of sub-frame periods and performing display on the display panel, wherein the control part divides each of the sub-frame periods into a writing period for writing the video signal to the pixel matrix and a display period for lighting up the light source, and applies a correction voltage that is different from the video signal to the data line in the display period.

When the present invention is built as a control program, it is structured as follows. That is, the control program according to still another exemplary aspect of the invention is structured as a control program for drive-controlling a display panel that includes: a pixel matrix in which pixels each including at least a switching element and a pixel electrode are arranged in matrix near intersection points of data lines and gate lines arranged longitudinally and laterally, and a counter electrode that is arranged to oppose the pixel matrix with a liquid crystal layer interposed therebetween. The program allows a computer to execute: a function of dividing a frame period for displaying a video signal of one screen into a plurality of sub-frame periods and displaying images on the display panel; and a function of dividing each of the sub-frame periods into a writing period for writing the video signal to the pixel matrix and a display period for lighting up the light source, and applying a correction voltage that is different from the video signal to the data line in the display period.

When the present invention is built as a driving method, it is structured as follows. That is, the driving method according to still another exemplary aspect of the present invention is structured as a driving method for drive-controlling a display panel that includes: a pixel matrix in which pixels each including at least a switching element and a pixel electrode are arranged in matrix near intersection points of data lines and gate lines arranged longitudinally and laterally, and a counter electrode that is arranged to oppose the pixel matrix with a liquid crystal layer interposed therebetween. The method includes: dividing a frame period for displaying a video signal of one screen into a plurality of sub-frame periods and displaying images on the display panel, and dividing each of the sub-frame periods into a writing period for writing the video signal to the pixel matrix and a display period for lighting up the light source, and applying a correction voltage that is different from the video signal to the data line in the display period.

As an exemplary advantage according to the invention, the present invention can improve the picture quality of a field sequential type liquid crystal display device by reducing flickers of a liquid crystal display device that uses liquid crystal molecules exhibiting a high response speed, and provide a liquid crystal display device in which the light utilizing efficiency is improved dramatically. Further, the driving method and the drive control program of the liquid crystal display device can be provided. Furthermore, compact and low cost portable terminal device and projector device can be realized by using such liquid crystal display device.

DETAILED DESCRIPTION OF THE EXEMPLARY EMBODIMENTS

The exemplary embodiments of the present invention will now be described in detail with reference to the drawings.

As shown in FIG. 1 to FIG. 28, a liquid crystal display device according to the exemplary embodiment of the present invention includes, as a basic configuration, a display panel that includes a pixel matrix in which pixels each including at least a switching element (pixel TFT 11) and a pixel electrode 44 are arranged in matrix in the vicinity of intersection points of data lines (D1 to D10, 18) and gate lines (G1 to G8, 18) arranged vertically and horizontally, and a counter electrode 41 arranged by opposing to the pixel matrix with a liquid crystal layer interposed therebetween; a light source 24 for irradiating light onto the display panel; and a control part 22 for dividing a frame period for displaying the video signal of one screen into a plurality of sub-frame periods and performing the display on the display panel; where the control part 22 divides the sub-frame period into a period of writing the video signal to the pixel matrix and a display period of lighting the light source, and applying a correction voltage different from the video signal to the data line in the display period.

In the exemplary embodiment of the present invention, the frame period for displaying the video signal of one screen is divided into a plurality of sub-frame periods to perform display on the display panel, and the sub-frame period is divided into a period of writing the video signal to the pixel matrix and a display period of lighting the light source, where a correction voltage different from the video signal is applied to the data line in the display period.

The present invention can improve the picture quality of a field sequential type liquid crystal display device by reducing flickers of a liquid crystal display device that uses liquid crystal molecules exhibiting a high response speed, and to provide a liquid crystal display device in which the light utilizing efficiency is improved dramatically.

The liquid crystal display device according to the exemplary embodiments of the present invention will be described in further detail using specific examples.

[First Exemplary Embodiment]

Figure 1:
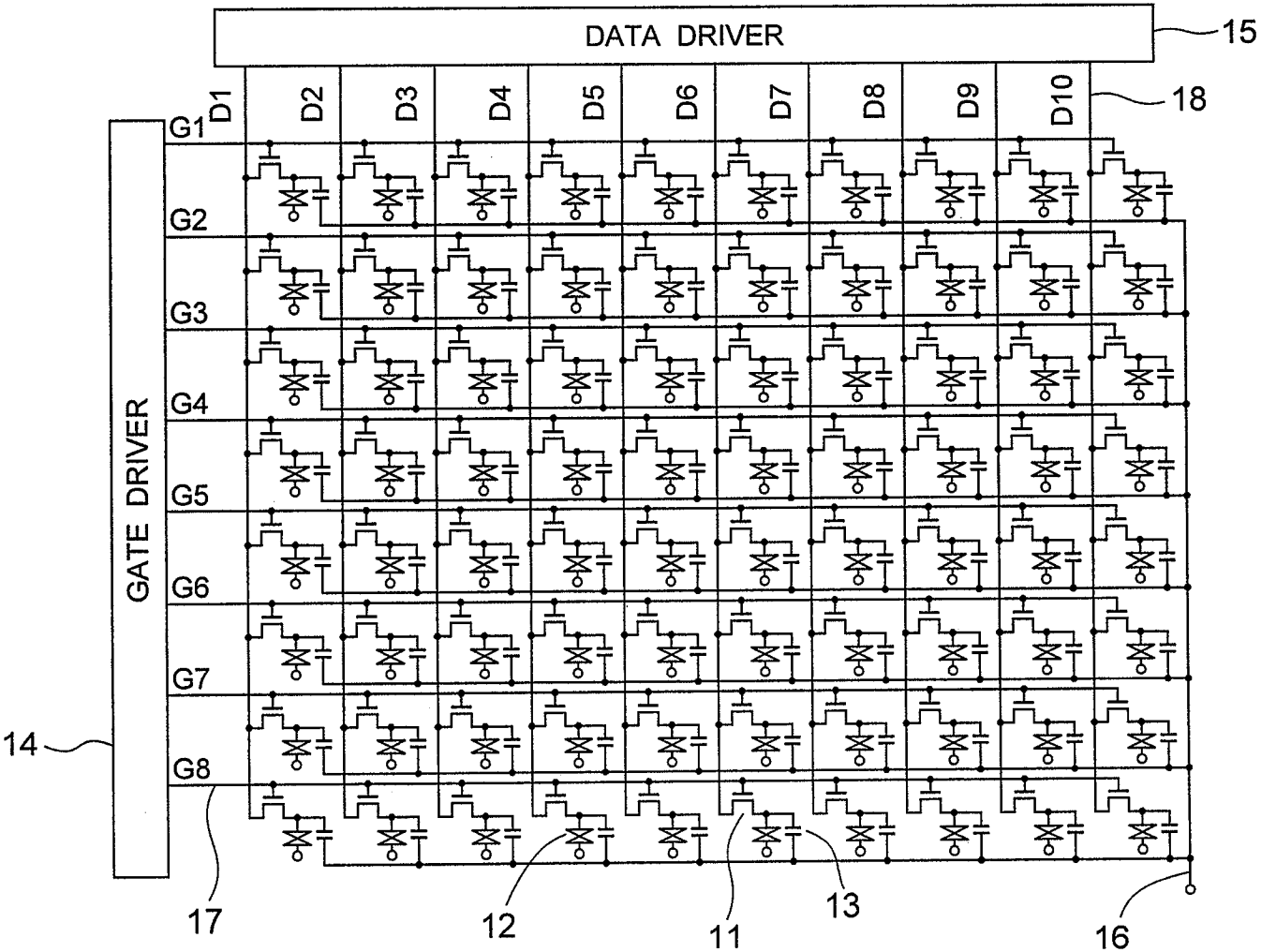
FIG. 1 is a circuit diagram showing a configuration of a TFT substrate of a display device body used in a first exemplary embodiment of a liquid crystal display device of the invention.

FIG. 1 is a circuit diagram showing a structure of a TFT substrate of a display device body used in a first exemplary embodiment of the liquid crystal display device of the present invention.

The display device body (display panel) of the first exemplary embodiment is structured with a TFT substrate that includes: a pixel matrix in which pixels each including at least a pixel TFT (switching element) 11 and a liquid crystal capacitance (Clc) 12 are disposed in matrix at each intersection point of the data lines D1-D10 and the gate lines G1-G8 arranged vertically and laterally; and a data driver circuit 15 disposed in the periphery of the pixel matrix for driving the data lines D1-D10 as well as a gate driver circuit 14 disposed in the periphery for driving the gate lines G1-G8. Further, a common counter electrode (common electrode) is disposed at each pixel, and liquid crystals are filled between the TFT substrate and a counter substrate that is disposed by opposing to the TFT substrate. An alignment film for aligning the liquid crystal molecules is provided on the surfaces of the TFT substrate and the counter substrate, respectively.

In this example, ten data lines and eight gate lines are illustrated. However, the numbers of those lines are not limited to such values. Further, an accumulative capacitance (Cst) 13 may be provided to the pixels. Furthermore, the data driver circuit 15 and the gate driver circuit 14 may be formed with TFTs on the TFT substrate, may be formed by mounting driver ICs on the TFT substrate, or circuits that are provided outside the TFT substrate and connected via a cable or the like may be used.

Next, actions of the first exemplary embodiment will be described by referring to a timing chart of FIG. 2. Tf is a frame period for displaying a color image of one screen, and the frame period is divided into at least three sub-frame periods Tsf_r, Tsf_g, and Tsf_b in the first exemplary embodiment.

The actions in each sub-frame period will be described. In the sub-frame period Tsf_r, the gate driver circuit 14 outputs a pulse to the gate lines G1-G8 for successively turning the pixel TFTs 11 to ON-state. The data driver circuit 15 outputs a video signal of red (R) to the data lines D1-D10 by synchronizing with the output of the gate driver circuit 14.

Through such actions, the video signal is written successively to each pixel row along the gate lines G1-G8. During a period where a control signal LED_R becomes high level, which is after a certain period past from the time where the video signal is written to the last pixel row that is connected to the gate line G8, the light source of red (R) is lighted up, and an image of red (R) is displayed thereby.

During the period the video signal is being written, a voltage VCOM, which applies a large electric field to the liquid crystal, is applied to the counter electrode, the polarities of the video signals for VCOM are changed by a sub-frame unit to perform AC drive. That is, as shown in FIG. 2, the data line signals D1 to D10 that become video signals are made to negative polarity when the counter electrode voltage VCOM is positive polarity, and the data line signals D1 to D10 that become video signals are made to positive polarity when the counter electrode voltage VCOM is negative polarity.

The dotted line in the data line signal and the counter electrode voltage in FIG. 2 indicate a reference voltage level shown to clarify the polarity of each signal, and this is the same for each timing chart described below.

Assuming the period for writing the video signal in the sub-frame period is the write period and the period from completing the writing until the next sub-frame is the display period, a correction signal or an alternating signal having a certain amplitude is to be input to the data line during this display period. The voltage VCOM of the counter electrode takes a constant value during the display period.

Figure 2:
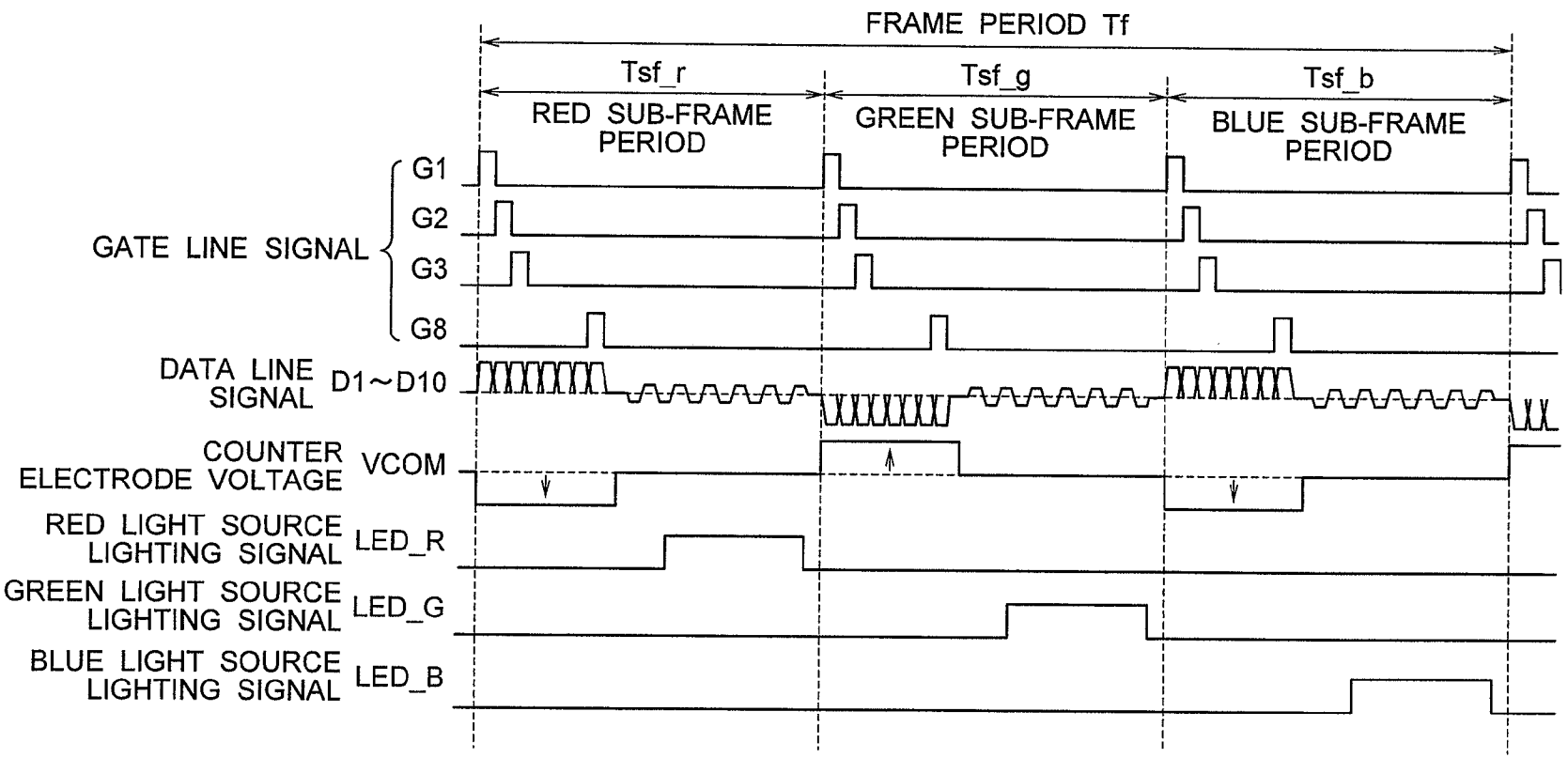
FIG. 2 is a timing chart showing a driving method of the first exemplary embodiment shown in FIG. 1.

In FIG. 2, the correction signal is shown as a rectangular wave signal, but may be a sine wave, a triangular wave, or a trapezoid waveform. However, the frequency needs to be the same as or higher than a frequency expressed by an inverse number of the response speed of the liquid crystal material used in the liquid crystal display device. The response speed of the liquid crystal material herein indicates a total time that is a sum of the time where the transmittance of the liquid crystal display device changes from 10% to 90%, and the time the transmittance changes from 90% to 10%.

In the sub-frame period Tsf_g, the gate lines G1-G8 are driven by the gate driver circuit 14 successively as in the case of the period Tsf_r, and the data driver circuit 15 outputs a video of green (G) to the data lines D1-D10 by synchronizing therewith to write the image of green (G) to all the pixels. By lighting up the light source of green (G) during a period where a control signal LED_G is in high level, the image of green (G) is displayed. Similarly, an image of blue (B) is displayed in the sub-frame period Tsf_b. Through a series of such actions, an observer of the liquid crystal display device comes to recognize the images of red (R), green (G), and blue (B) as a color image by a color mixing effect achieved in terms of time.

The polarity of the video signal with respect to the common electrode to be applied to each pixel in each sub-frame period is changed for every sub-frame period and is the same during one sub-frame period.

Figure 3:
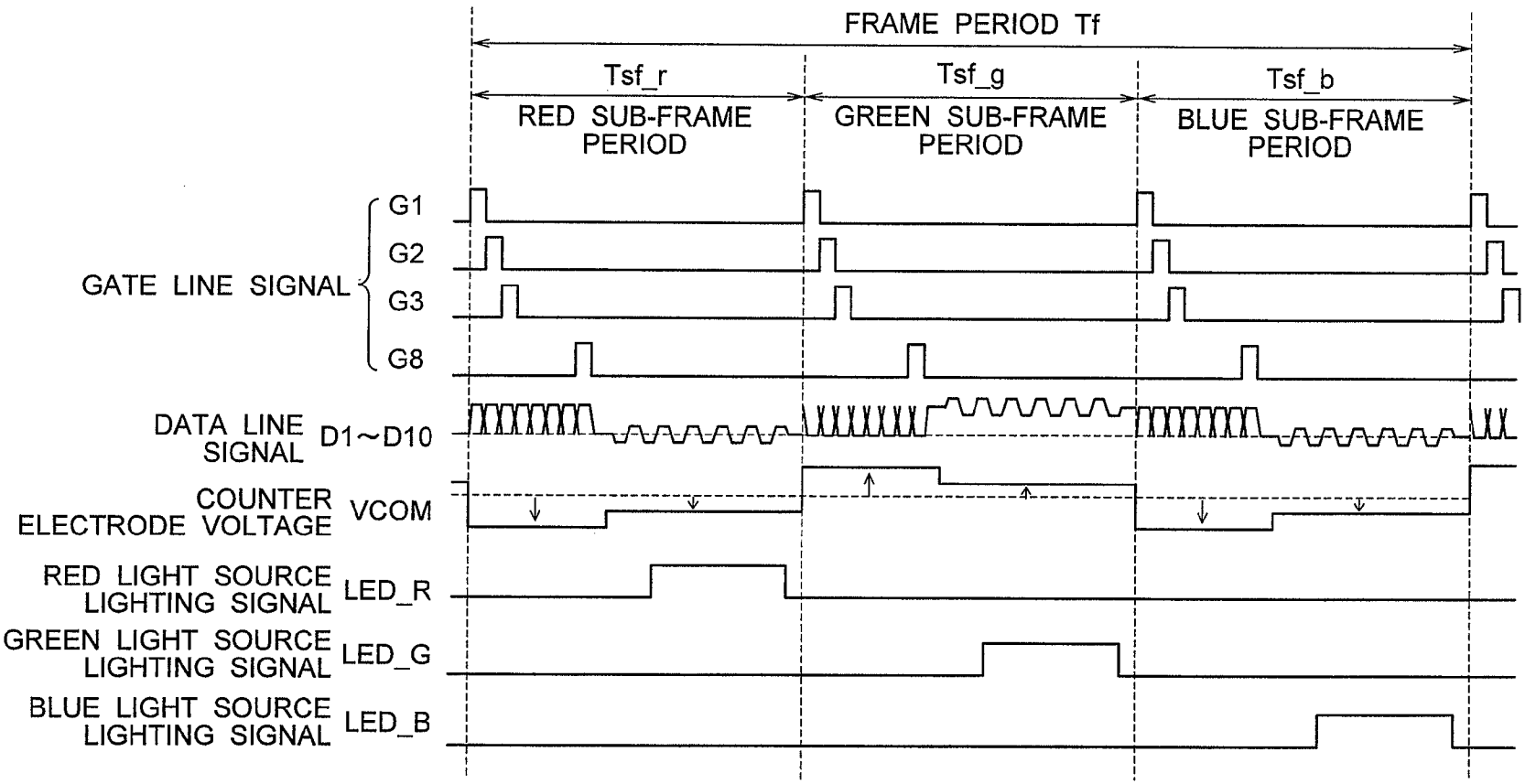
FIG. 3 is a timing chart showing another driving method of the first exemplary embodiment shown in FIG. 1.

In the example of FIG. 2, illustrated herein is an example where the counter electrode potential VCOM is set to a constant potential during the display period, and the polarities of the video signal for VCOM are changed by a sub-frame unit so as to achieve an AC drive. However, it is also possible to use an AC driving method which changes the potential of VCOM by a sub-frame unit during the display period. In FIG. 3, a case where the polarity of the data line signal is at the reference voltage or in a positive range therefrom is shown.

Flickers are generated when a difference is created in frame units in the fluctuation amount of the video signal voltage held in the pixel. The voltage fluctuation mainly occurs by the leakage current of the pixel TFT, and the leakage current of the TFT changes with the source-drain voltage and the source-gate voltage of the pixel TFT.

In the present exemplary embodiment, the correction signal or the alternating signal having a frequency of greater than or equal to a certain frequency is to be input to the data line in the display period. Thus, the source-drain voltage and the source-gate voltage of the pixel TFT can be arbitrarily set by the correction signal in the display period, and the leakage current of the pixel TFT in the display period can be equalized irrespective of the polarity of the video signal for the counter electrode. Therefore, flickers can be greatly reduced.

An optimum value of the amplitude of the correction voltage in such driving method can be obtained through changing the amplitude while observing flickers of the liquid crystal display device.

Figure 4:
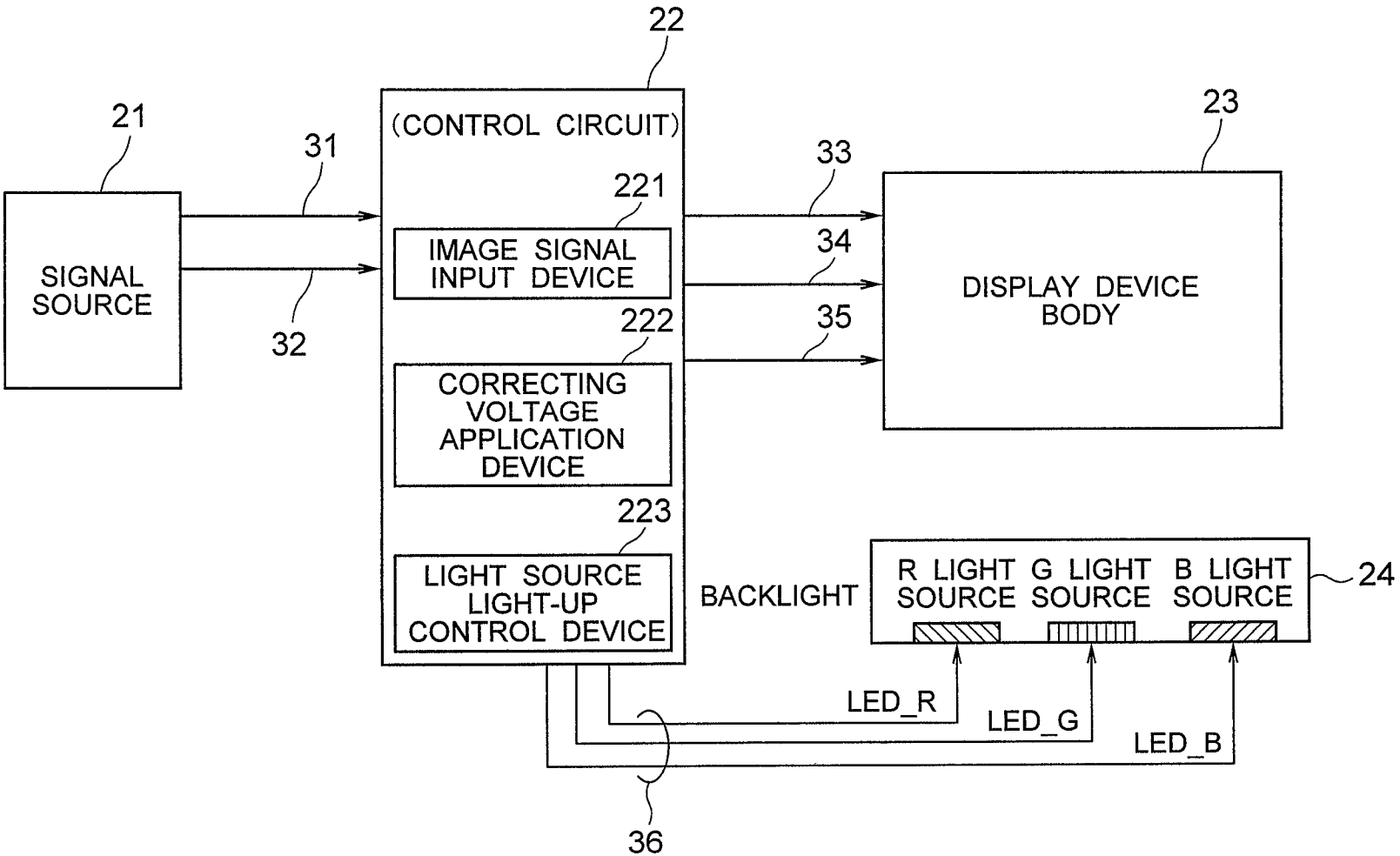
FIG. 4 is a block diagram showing a configuration of an entire liquid crystal display device of the first exemplary embodiment of the invention.

FIG. 4 shows a block diagram of the liquid crystal display device according to the first exemplary embodiment of the invention. For performing color displays by using the liquid crystal display device according to the first exemplary embodiment of the invention, it is necessary to provide the control circuit 22 for driving a display device main body 23, a backlight 24 that is capable of controlling light-up of the light sources of red (R), green (G), and blue (B) individually, and a signal source 21 for generating a video signal 31. The control circuit 22 includes: a video signal input device 221 which generates, by using the video signal 31 and a synchronous signal 32 from the signal source 21, a video signal 33 and a control signal 34 required for driving the display device main body 23; a correction voltage application device 222 for applying a correction voltage signal 35 on the data lines in the display period of the display device main body 23, and a light source light-up control device 223 which outputs a BL control signal 36 for controlling the backlight 24 by synchronizing with the action of the display device main body 23.

The backlight 24 has a function that is capable of lighting up the light sources of red (R), green (G), and blue (B) individually based on the BL control signal 36 from the light source light-up control device 223 of the control circuit 22. As an example of such light source, an LED can be used.

Further, although not shown, it is necessary to provide a power supply for supplying a voltage to the control circuit 22, the display device main body 23, and the backlight 24.

Figure 5:
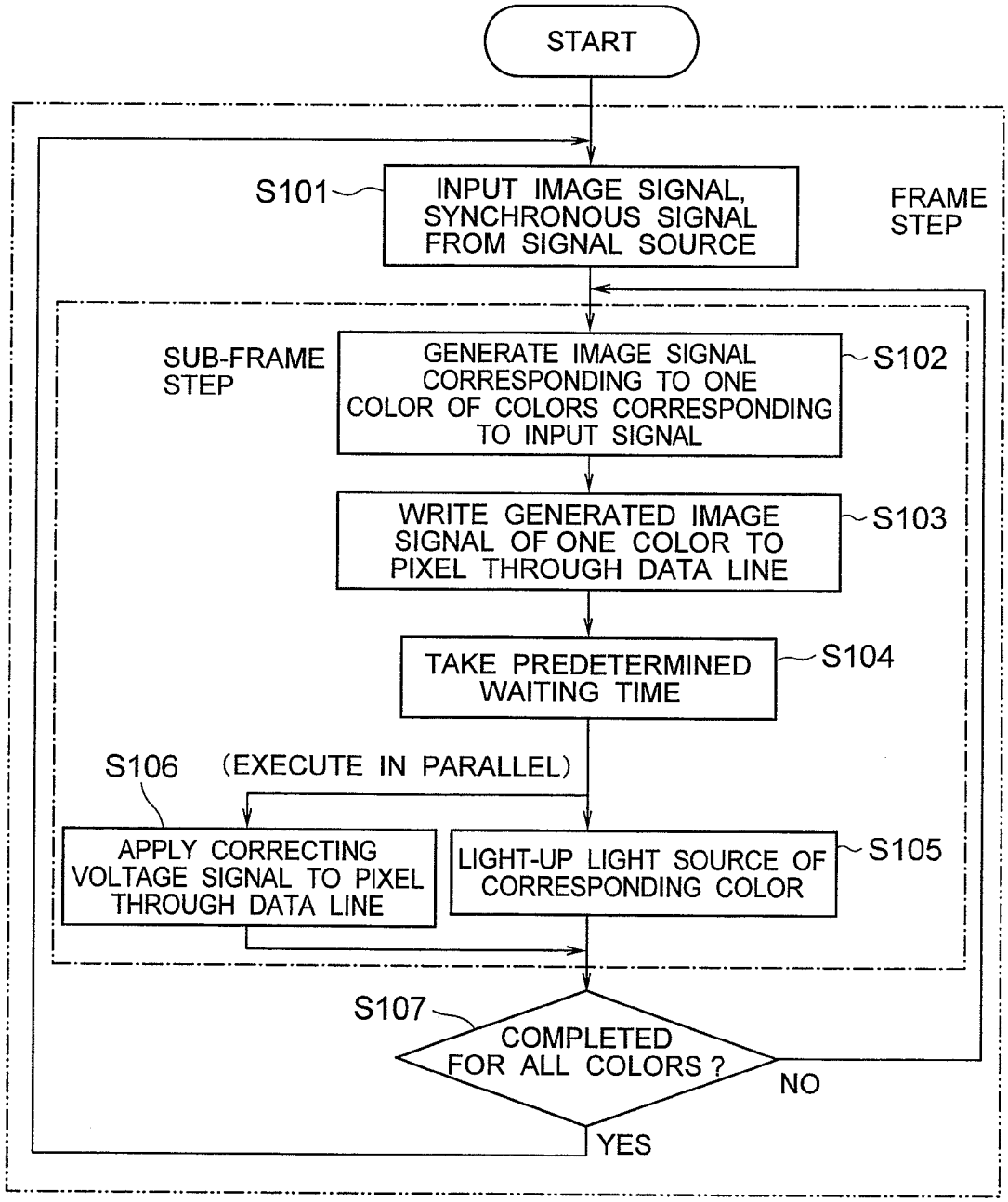
FIG. 5 is a flowchart showing an action of the entire liquid crystal display device shown in FIG. 4.

Actions of the control circuit 22 of the liquid crystal display device for driving the first exemplary embodiment of the invention will be described by referring to a flowchart of FIG. 5.

When an action of the liquid crystal display device is started, in step S101, the control circuit 22 receives inputs of the video signal 31 and the synchronous signal 32 from the signal source 21. Then, in step S102, the procedure is advanced to one of sub-frame steps where a video signal corresponding to one color among each of the colors is formed in accordance with the inputted signal.

The video signal 33 corresponding to one color among each of the colors formed in this manner by corresponding to the inputted signal is written in step S103 to the pixels via the data lines by using the video signal input device 221 (writing step). After completing the writing, a prescribed waiting time is secured in step S104, and the light source of the corresponding color is lighted up in step S105 by using the light source light-up control device 223 (display step).

In parallel with the action of the displaying step of step S105, the correction voltage application device 222 applies the correction voltage signal different from the video signal to the pixel through the data line in step S106 (correction voltage applying step). A series of actions from the step S102 to the step S106 corresponds to one sub-frame step.

After finishing this sub-frame step, it is judged in step S107 to find out whether or not the sub-frame step is completed for all the colors. When judged that it is not completed for all the colors, the procedure returns to the step S102 to execute the sub-frame step for the next color. After completing the sub-frame step for all the target colors, the procedure is returned to the step S101 to input a next input signal.

A series of actions from the step S101 to the step S107 shown herein corresponds to one frame step. A color image for one frame is displayed by this one frame step.

The image is displayed by repeating the frame step.

[Second Exemplary Embodiment]

Figure 6:
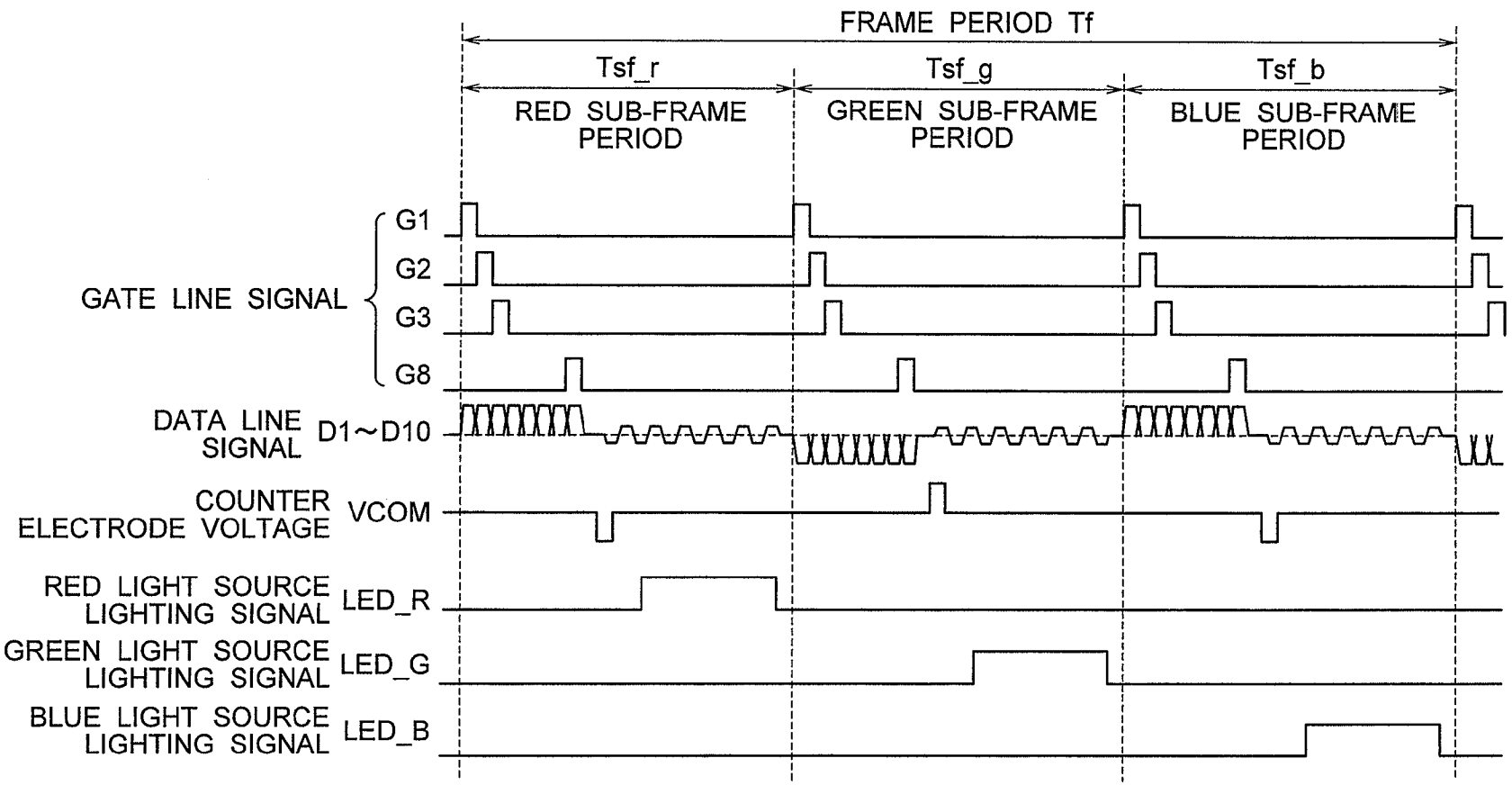
FIG. 6 is a timing chart showing a driving method of a second exemplary embodiment of the invention.

FIG. 6 is a timing chart showing a driving method of a second exemplary embodiment of the present invention.

The configuration of the liquid crystal display device is the same as that shown in FIG. 1.

This driving method differs from the driving method shown in FIG. 2 in the manner of changing the counter electrode potential VCOM.

In the method of the first exemplary embodiment shown in FIG. 2, the voltage, which applies a large electric field to the liquid crystal, is applied to the counter electrode during the period of writing the video signal to the liquid crystal display device, but in the driving method of the second exemplary embodiment shown in FIG. 6, the voltage, which applies a large electric field to the liquid crystal, is applied to the counter electrode during a short period of after the write of the video signal is completed and before the light source is lighted. The aspect of applying the correction signal having a frequency of greater than or equal to a certain frequency to the data line during the display period after the write is completed is the same as that of the driving method shown in FIG. 2.

In the driving method of the second exemplary embodiment, the luminance unevenness in the plane due to the difference in time the video signal is written to each pixel of the liquid crystal display device is resolved by aligning the response time of the liquid crystal molecules of all the pixels by having the potential of the frequency electrode at the voltage, which applies a larger electric field to the liquid crystal than the maximum voltage applied to the liquid crystal in the display state, after the video signal is written to all the pixels.

The driving method of the second exemplary embodiment has the following advantages.

In the driving method shown in FIG. 2 of the first exemplary embodiment, a voltage different from the voltage in the display state is applied to the counter electrode while writing the video signal to the liquid crystal display device. Thus, a difference is created between the voltage written to the pixel during the write of the video signal and the voltage of the pixel in the display state. This is because redistribution of charges occurs between the pixel electrode and accumulative capacitance electrode and other parasitic capacitance as a result of change in the potential of the counter electrode, and the pixel voltage fluctuates.

The problem that arises here is that variance of a certain extent is generated in the parasitic capacitance and the accumulative capacitance in the manufacturing process of the TFT substrate, which causes display unevenness when variance is generated at the inner surface of the liquid crystal display device.

The method shown in FIG. 4 does not cause display unevenness even if variance is generated in the capacitances since the potential of the counter electrode is the same in time of writing the video signal and in time of display. However, this method has a drawback in that the period of lighting the light source of BL becomes shorter and the luminance lowers since a period of changing the voltage of the counter electrode needs to be provided after the write of the video signal.

The optimum value for the amplitude of the correction voltage in such driving method is found by varying the amplitude while monitoring flickers of the liquid crystal display device.

[Third Exemplary Embodiment]

Figure 7:
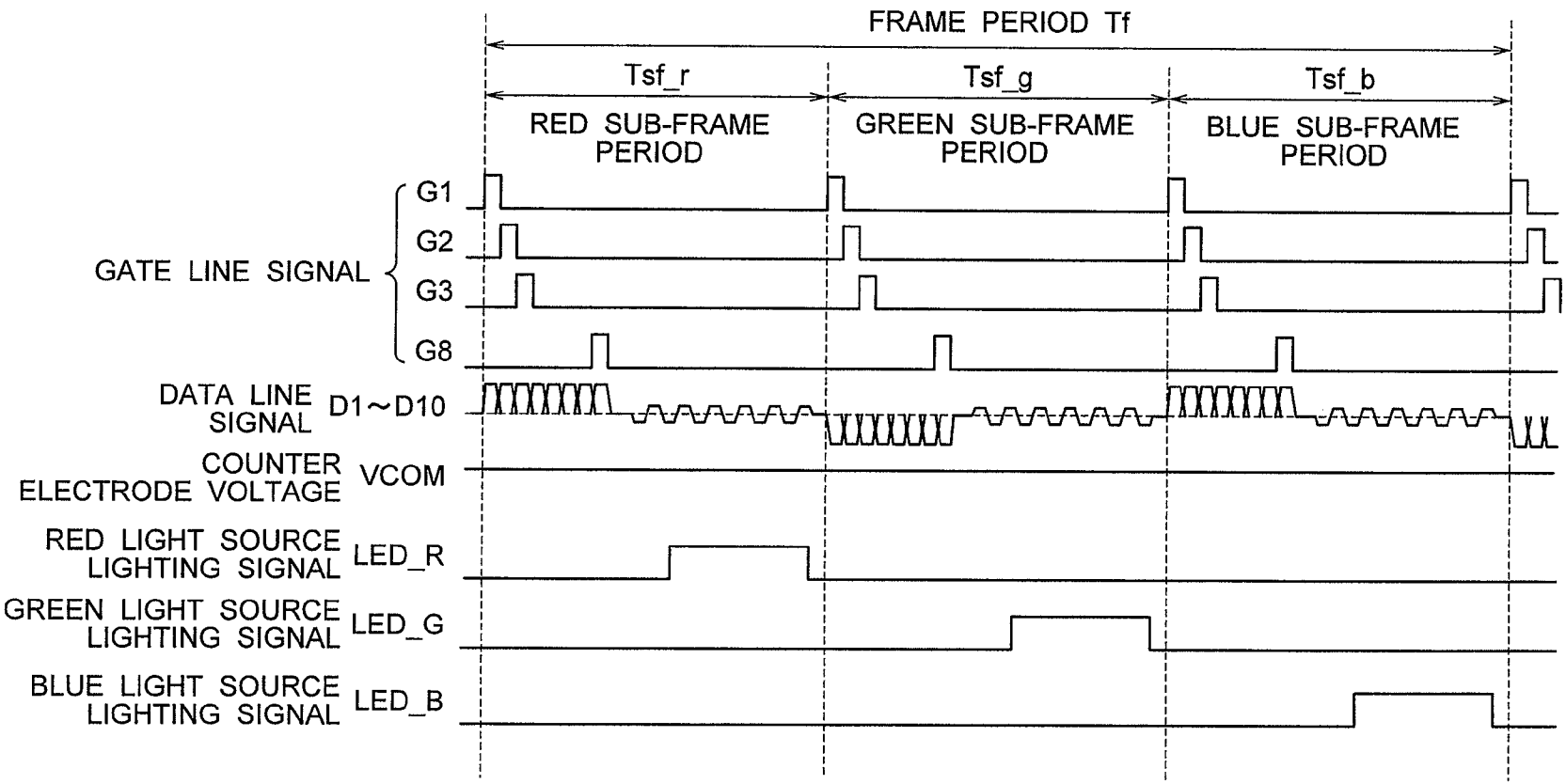
FIG. 7 is a timing chart showing a driving method of a third exemplary embodiment of the invention.

FIG. 7 is a timing chart showing a driving method of a third exemplary embodiment of the present invention.

The configuration of the display device main body is the same as that shown in FIG. 1.

The driving method of the third exemplary embodiment differs from the driving method of the first exemplary embodiment shown in FIG. 2 in that the counter electrode potential VCOM is not changed at all. In the driving method of the first exemplary embodiment shown in FIG. 2, the voltage, which applies a large electric field to the liquid crystal, is applied to the counter electrode while writing the video signal to the liquid crystal display device, but in the driving method of the third exemplary embodiment shown in FIG. 7, the counter electrode potential VCOM is not changed at all during the period of writing the video signal and during the display period. The aspect of applying the correction voltage having a frequency of greater than or equal to a certain frequency to the data line in the display period after the write is completed is the same as the driving method shown in FIG. 2.

The driving method of the third exemplary embodiment has the following advantages. In the driving method of the first exemplary embodiment shown in FIG. 2, the voltage different from a voltage in the display state is applied to the counter electrode while writing the video signal to the liquid crystal display device. Thus, a difference is created between the voltage written to the pixel during the write of the video signal and the voltage of the pixel in the display state. This is because redistribution of charges occurs between the pixel electrode and accumulative capacitance electrode and other parasitic capacitance as a result of change in the potential of the counter electrode, and the pixel voltage fluctuates.

The problem that arises here is that variance of a certain extent is generated in the parasitic capacitance and the accumulative capacitance in the manufacturing process of the TFT substrate, which causes display unevenness when variance is generated at the inner surface of the liquid crystal display device.

The driving method of the third exemplary embodiment shown in FIG. 7 does not cause display unevenness even if variance is generated in the capacitances since the potential of the counter electrode is the same in time of writing the video signal and in time of display. However, in this driving method, a liquid crystal material exhibiting a high response speed at which the generation of the luminance unevenness in the plane due to difference in time the video signal is written to each pixel of the liquid crystal display device does not occur needs to be used. The response speed is required to be at least lower than or equal to 1 ms.

The optimum value for the amplitude of the correction voltage in such driving method is found by varying the amplitude while monitoring flickers of the liquid crystal display device.

[Fourth Exemplary Embodiment]

Figure 8:
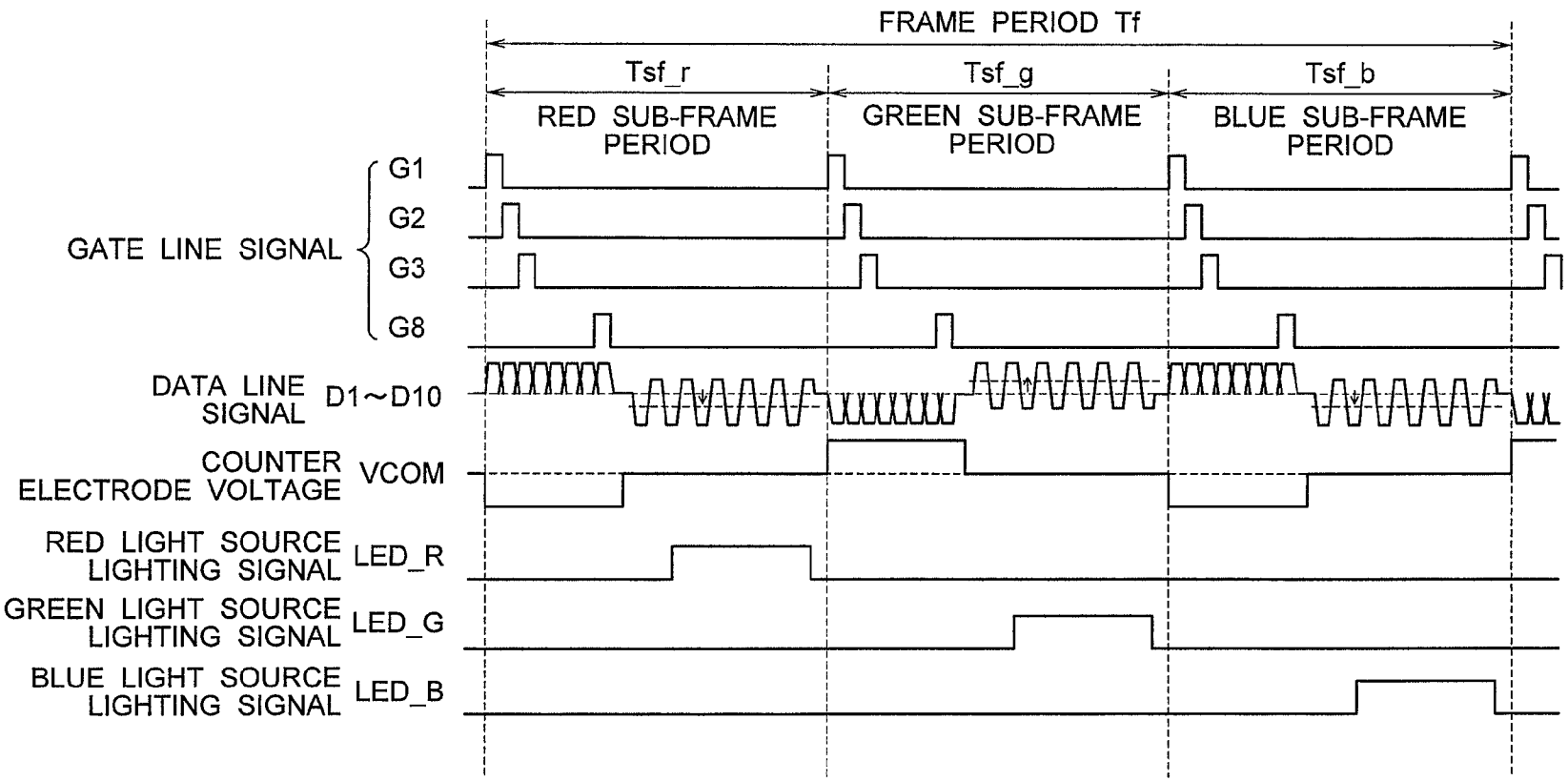
FIG. 8 is a timing chart showing a driving method of a fourth exemplary embodiment of the invention.

FIG. 8 is a timing chart showing a driving method of a fourth exemplary embodiment of the present invention.

The configuration of the liquid crystal display device is the same as that shown in FIG. 1.

The driving method of the fourth exemplary embodiment differs from the driving method of the first exemplary embodiment shown in FIG. 2 in that a central voltage of the correction signal to be applied to the data line is changed according to the polarity of the video signal with respect to the counter electrode during the display period of after the write of the video signal is completed for all the pixels of the liquid crystal display device. That is, the central voltage of the correction signal is shifted to the negative side when the data line signal is positive polarity and the central voltage (offset) of the correction signal is shifted to the positive side when the data line signal is negative polarity as shown in FIG. 8.

The driving method of the fourth exemplary embodiment has the following advantages.

In the driving method shown in FIG. 2 of the first exemplary embodiment, the same correction voltage is applied to the data line irrespective of the polarity of the video signal with respect to the counter electrode. However, with this method, the difference in pixel voltage fluctuation may not be completely corrected due to the difference in polarity of the video signal with respect to the counter electrode. As described above, the fluctuation in pixel voltage occurs as the magnitude of the leakage current of the pixel TFT depends on the source-drain voltage and the source-gate voltage. If the dependency is large, the difference in pixel voltage fluctuation cannot be uniformized with the driving method of the first exemplary embodiment shown in FIG. 2. Thus flickers cannot be sufficiently reduced.

In the fourth exemplary embodiment, since the correction signal is changed according to the polarity of the video signal with respect to the counter electrode, the difference in pixel voltage is further uniformized, and the flickers can be sufficiently reduced. The method of changing the correction voltage includes a method of changing the amplitude, a method of changing the offset or the center value of the amplitude, a method of changing the frequency, or the like.

[Fifth Exemplary Embodiment]

Figure 9:
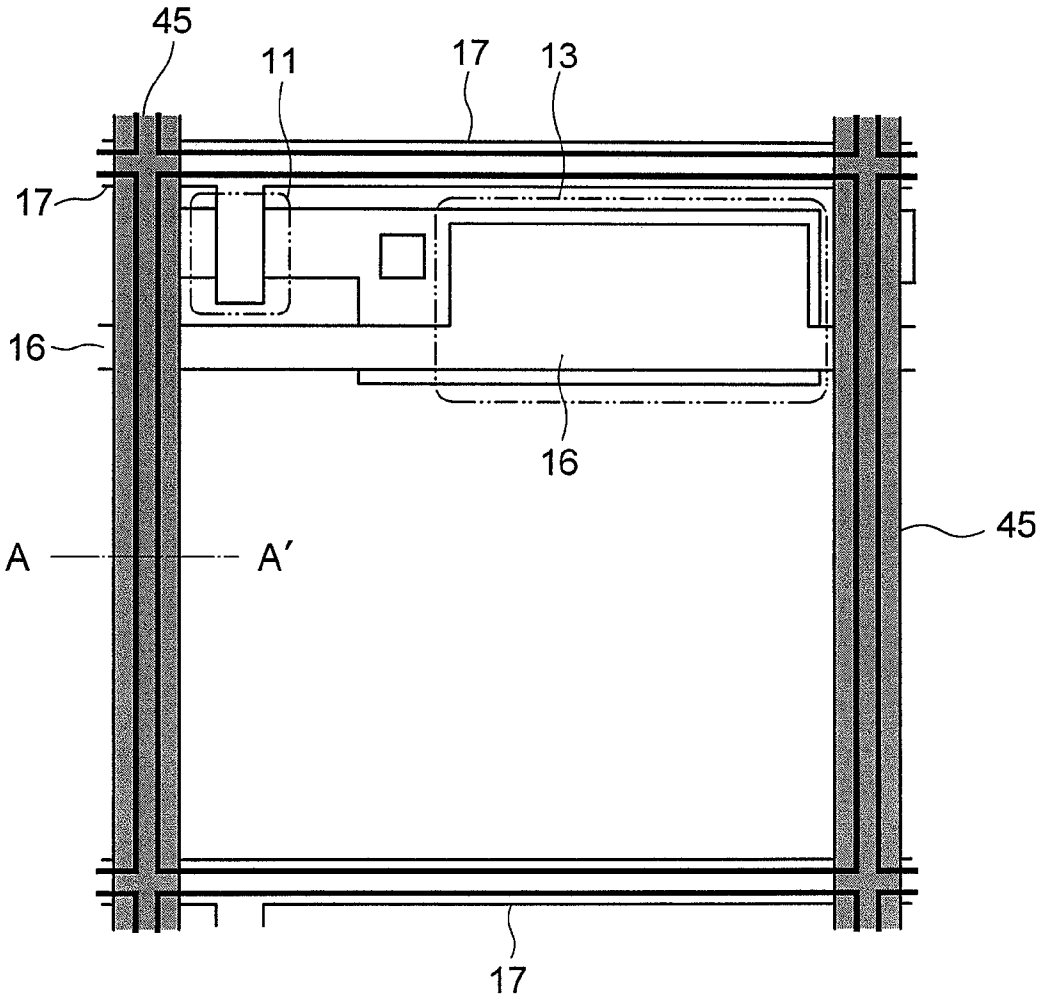
FIG. 9 is a plan view showing a layout of one pixel of a liquid crystal display device according to a fifth exemplary embodiment of the invention.
Figure 10:
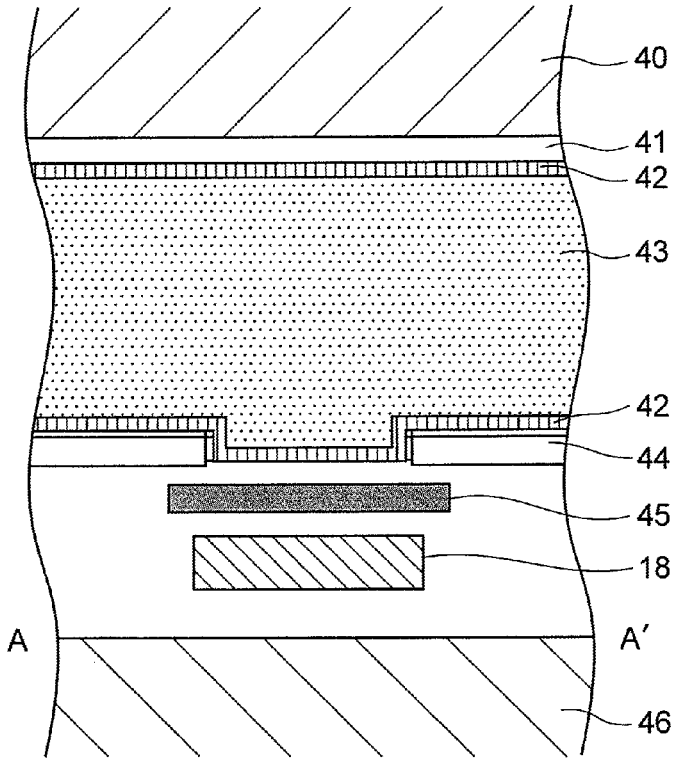
FIG. 10 is a partial cross sectional configuration view of one pixel taken along line A-A' of FIG. 9.

FIG. 9 shows a layout of one pixel of a display device main body according to a fifth exemplary embodiment of the present invention, and FIG. 10 shows a cross sectional configuration of the portion taken along line A-A' of FIG. 9.

In the liquid crystal display device of the present invention, a shield electrode 45 is arranged between the data line 18 and the pixel electrode 44. The shield electrode 45 is formed with a conductive film which is separated with an insulation film. More specifically, the shield electrode 45 is electrically-insulated with respect to the data line 18 and the pixel electrode 44. The shield electrode 45 merely needs to be a film having conductivity and may be metal such as Al and Cr, organic conductive film, transparent electrode, and the like. In FIG. 10, a TFT substrate 46 and a counter substrate 40 including a common counter electrode (common electrode) 41 arranged at each pixel are arranged facing each other, and the liquid crystal 43 is filled in between. An alignment film 42 for aligning liquid crystal molecules is arranged on the surfaces of the TFT substrate 46 and the counter substrate 40, respectively.

Although not shown, the conductive film is electrically connected to another conductive layer, and can be externally applied with voltage.

Figure 11:
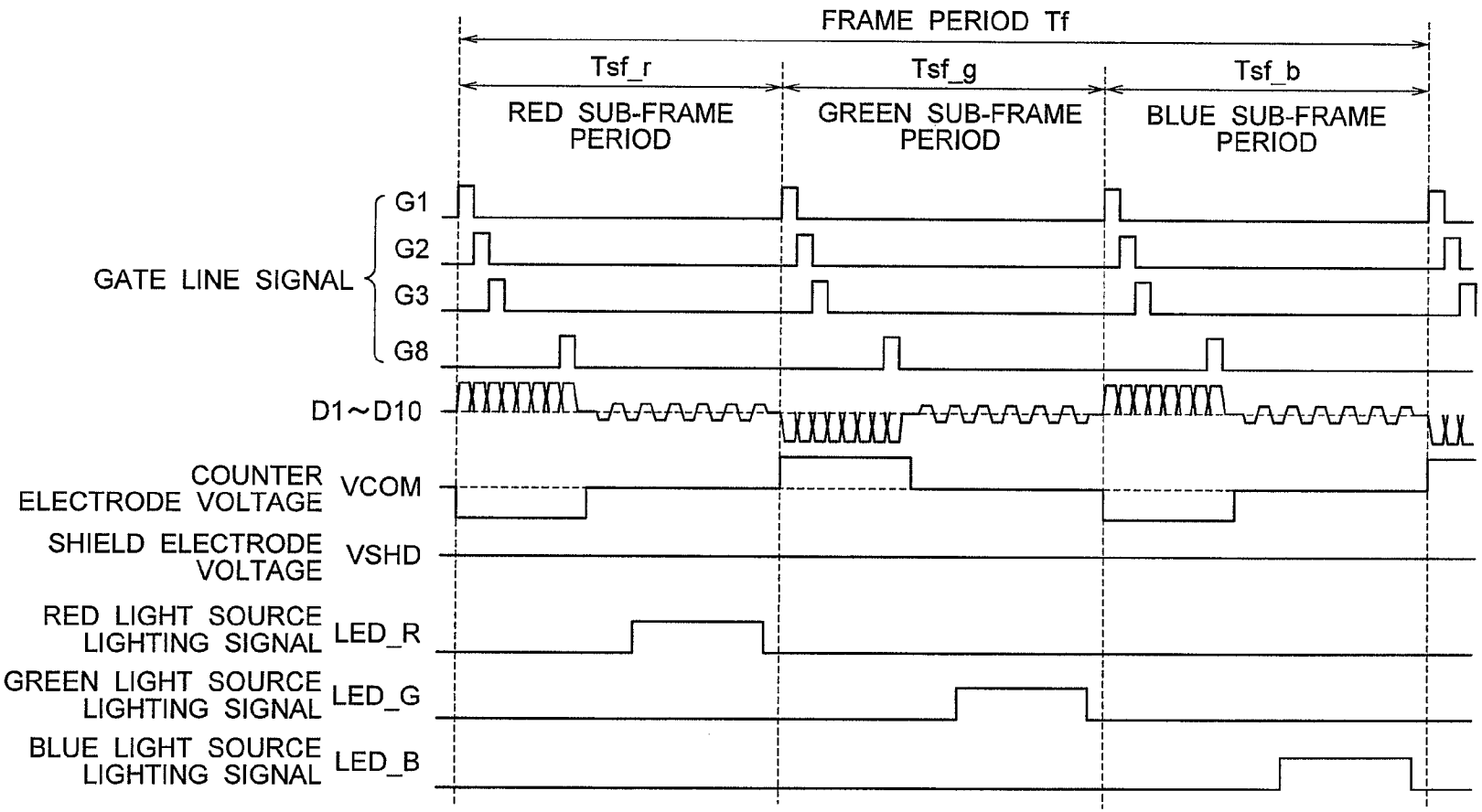
FIG. 11 is a timing showing a driving method of the liquid crystal display device according to the fifth exemplary embodiment of the invention.

FIG. 11 is a timing chart showing a driving method of the liquid crystal device of the fifth exemplary embodiment. In the figure, the voltage waveform indicated with the symbol VSHD refers to the voltage to be applied to the shield electrode, where a constant voltage is applied in this example. The driving method of other signals is the same as that of the first exemplary embodiment shown in FIG. 2.

The fifth exemplary embodiment has the following advantages.

In the field sequential type liquid crystal display device, the light utilizing efficiency is improved more and the luminance increases more when the response speed of the liquid crystal becomes higher. Thus, in this type, the liquid crystal material exhibiting a higher response speed is used compared to the liquid crystal display device of other types.

In the driving method of applying a voltage having an equal polarity with respect to the counter electrode to all the pixels of the liquid crystal display device, the generation of flickers caused by the leakage current of the pixel TFT becomes a large concern, as mentioned above, and the countermeasures therefor have been described. However, the following problems newly arise when the response speed of the liquid crystal material becomes extremely high. That is, the liquid crystal responds to a microscopic potential fluctuation of the pixel voltage due to capacitance coupling of the data line and the pixel electrode, which becomes a cause of flickers.

The flickers generated from such mechanism can be handled by sufficiently enhancing the write frequency of the video signal and the frequency of the correction signal. But, actually, if the frequency is enhanced and the speed is increased, the write of the video signal becomes insufficient, or, the power consumption increases in order to generate the video signal and the correction signal having high frequency.

In the fifth exemplary embodiment, the shield electrode is arranged between the data line and the pixel electrode, so that the coupling capacitance of the data line and the pixel electrode reduces, the fluctuation of the pixel voltage greatly reduces, and the flickers can be greatly reduced.

The shield electrode 45 is arranged between the data line 18 and the pixel electrode 44 in the example shown in FIG. 10, but may be arranged between the gate line 17 and the pixel electrode 44. In this case, the fluctuation of the pixel voltage due to potential fluctuation of the gate line 17 can also be reduced.

Further, the liquid crystal display device having the configuration in which the shield electrode is arranged may be combined with one of the driving methods described in the first to fourth exemplary embodiments.

[Sixth Exemplary Embodiment]

Figure 12:
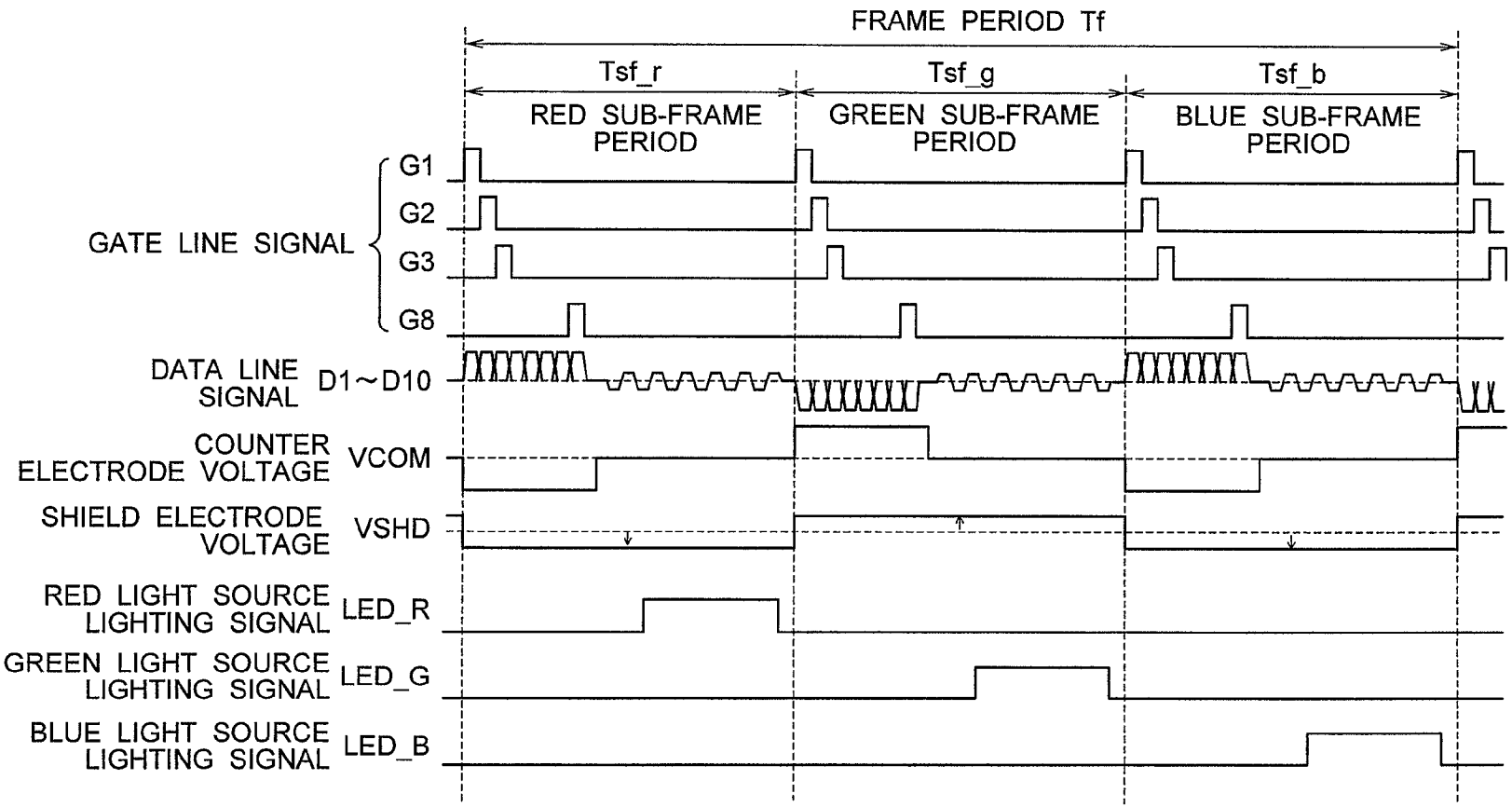
FIG. 12 is a timing showing a driving method of a liquid crystal display device according to a sixth exemplary embodiment of the invention.

FIG. 12 is a timing chart showing a driving method of a sixth exemplary embodiment of the present invention.

The same configuration as that of the fifth exemplary embodiment in which the shield electrode is arranged between the data line and the pixel electrode shown in FIG. 9 is used for the configuration of the liquid crystal display device.

The driving method of the sixth exemplary embodiment shown in FIG. 12 differs from the driving method of the fifth exemplary embodiment shown in FIG. 11 in that the voltage to be applied to the shield electrode is changed for each sub-frame. Other than the method of applying the shield voltage, the driving method may be the same as any one of the driving methods shown in the first to the fourth exemplary embodiments.

The sixth exemplary embodiment has the following advantages.

The shield electrode and the pixel electrode have capacitance coupling. Thus, by changing the potential of the shield electrode, the potential of the pixel electrode can be by changed. Therefore, even if a correction signal to be applied to the data line or flickers that cannot be resolved by simply arranging the shield electrode between the data line and the pixel electrode are generated, the amount of fluctuation of the pixel potential can be controlled by changing the potential of the shield electrode in sub-frame units thereby reducing the flickers.

The optimum value of the shield potential is found by varying the potential while monitoring flickers of the liquid crystal display device.

[Seventh Exemplary Embodiment]

Figure 13:
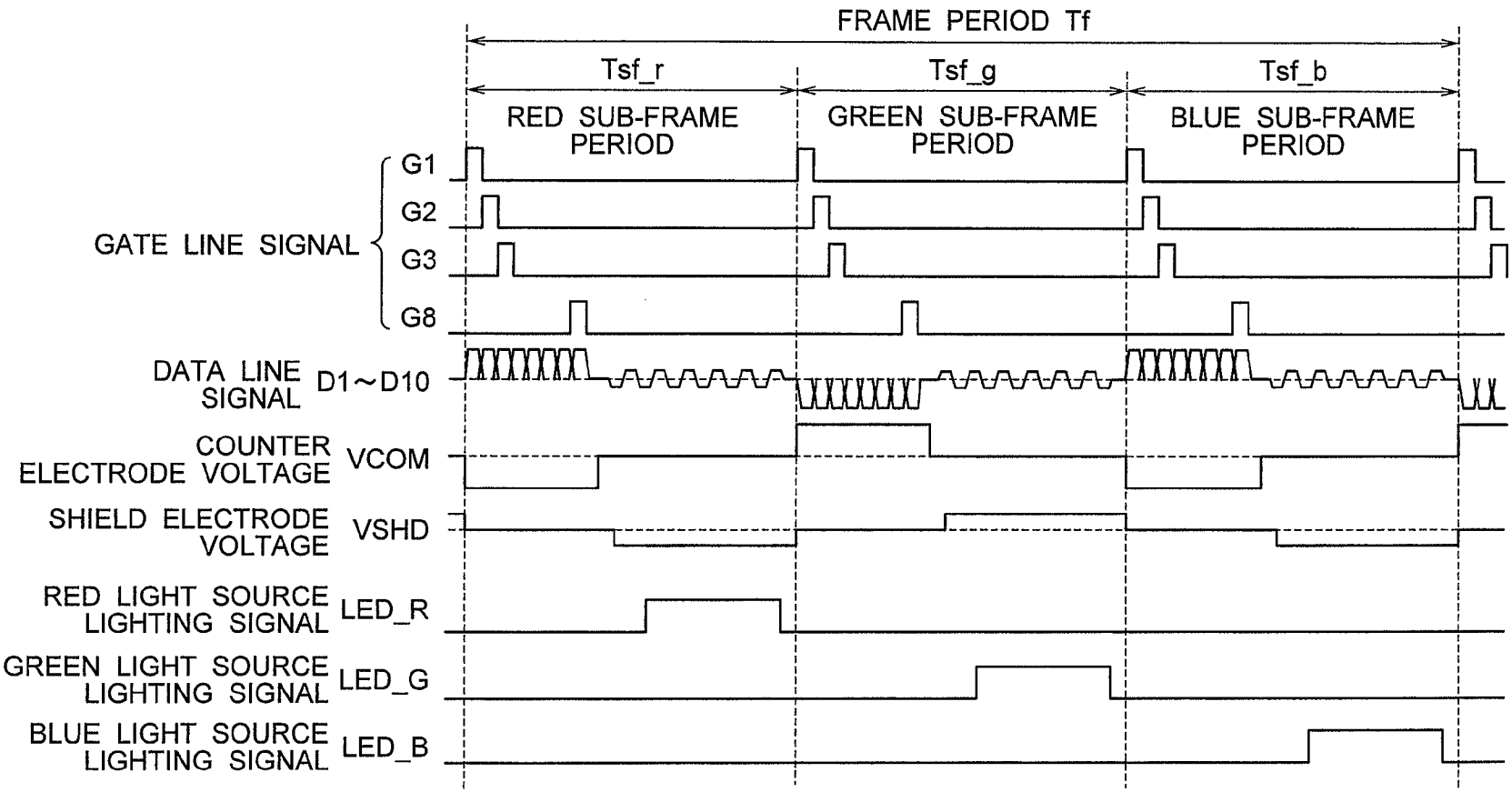
FIG. 13 is a timing showing a driving method of a liquid crystal display device according to a seventh exemplary embodiment of the invention.

FIG. 13 is a timing chart showing a driving method of a seventh exemplary embodiment of the present invention.

The same configuration as that of the fifth exemplary embodiment in which the shield electrode is arranged between the data line and the pixel electrode shown in FIG. 10 is used for the configuration of the liquid crystal display device.

The driving method of the seventh exemplary embodiment shown in FIG. 13 differs from the driving method of the sixth exemplary embodiment shown in FIG. 12 in that the voltage to be applied to the shield electrode is changed for each sub-frame, and the voltage to be applied to the shield electrode is changed between the period of writing the video signal to the liquid crystal display device and the period other than such period.

Other than the method of applying the shield voltage, the driving method may be the same as any one of the driving methods shown in the first to the fourth exemplary embodiments.

The seventh exemplary embodiment has the following advantages.

The shield electrode and the pixel electrode have capacitance coupling. Thus, by changing the potential of the shield electrode, the potential of the pixel electrode can be changed. Therefore, even if a correction signal to be applied to the data line or flickers that cannot be resolved by simply arranging the shield electrode between the data line and the pixel electrode are generated, the amount of fluctuation of the pixel potential can be controlled in more detail by changing the potential of the shield electrode in sub-frame units and between the write period and the display period and, as a result, the flickers can be reduced.

The optimum value of the shield potential is found by varying the potential while monitoring flickers of the liquid crystal display device.

[Eighth Exemplary Embodiment]

Figure 14:
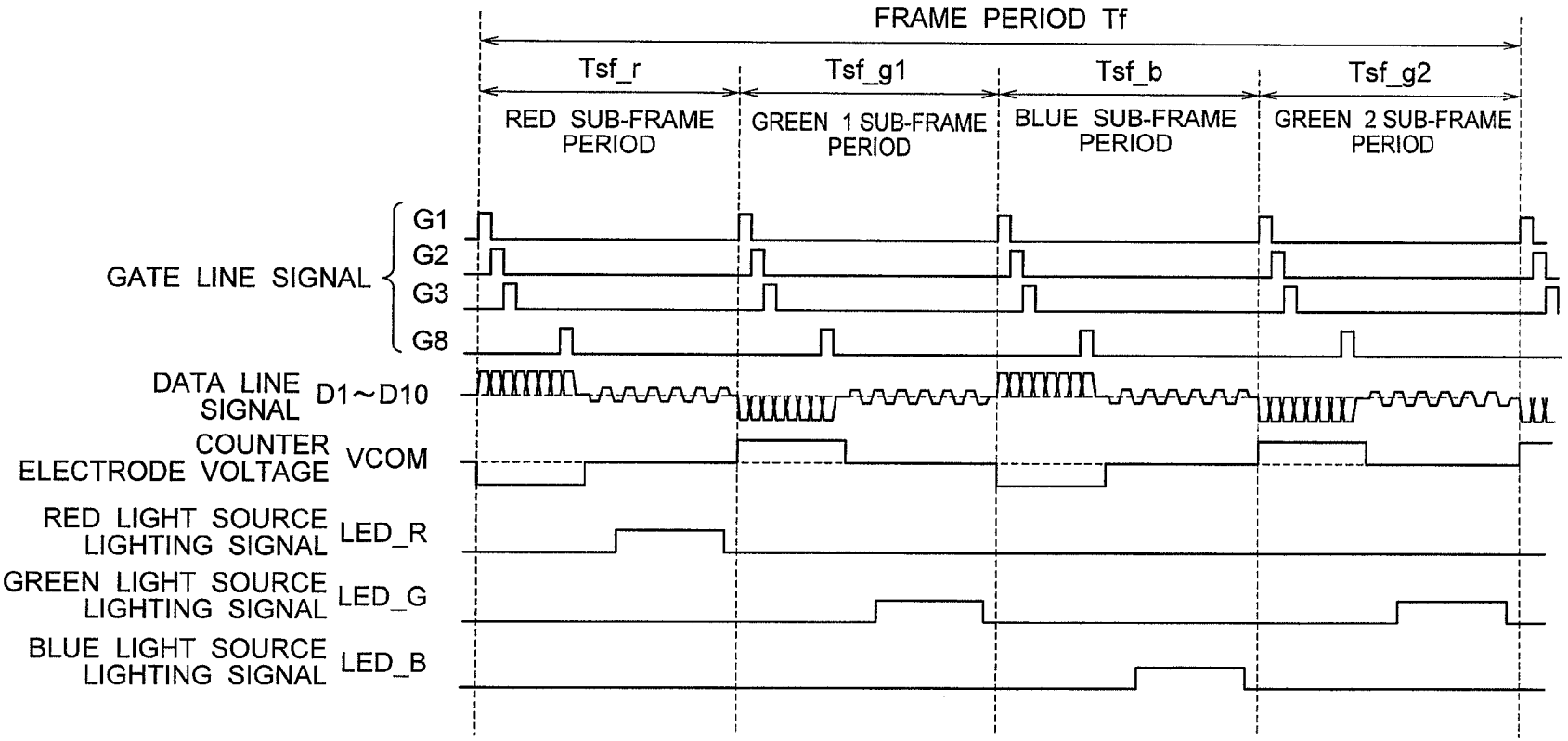
FIG. 14 is a timing showing a driving method of a liquid crystal display device according to an eighth exemplary embodiment of the invention.

FIG. 14 is a timing chart showing a driving method of an eighth exemplary embodiment of the liquid crystal display device of the present invention.

In this driving method, one frame period Tf is divided into four sub-frame periods Tsf_r, Tsf_g1, Tsf_b, and Tsf_g2. Actions in each frame period are substantially similar to the actions of the first exemplary embodiment shown in FIG. 2. An image of red (R) and an image of blue (B) are displayed in both of the periods Tsf_r and Tsf_b, respectively, and an image of green (G) is displayed in both of the periods Tsf_g1 and Tsf_g2.

This driving method has a merit in that the screen can be brightened since the image of G is displayed twice. Among the luminance of R, G, and B required for displaying adequate white on the liquid crystal display device, the luminance of G is the largest. The next is R, and B is the last. Therefore, it is necessary to increase the luminance of the light source of G of the backlight.

When LEDs are used for the light sources, the light emitting efficiency becomes deteriorated when the electric current flown to the LEDs is increased. Thus, it is necessary to increase the number of LEDs for G than the LEDs for other colors, or to drive the LEDs for G by a larger electric current than that of the LEDs for R and B. However, by displaying G twice in one frame, the luminance required per display can be made smaller. Thus, the electric current required thereby can be reduced as well. As a result, it becomes unnecessary to execute actions by deteriorating the light emitting efficiency. This makes it possible to obtain bright images even when the backlight is driven with the same electric power.

Because of the similar reasons, it is possible to brighten the screen further with a driving method which divides one frame into five sub-frames, and displays G and R twice.

Furthermore, in this driving method, the configuration of the liquid crystal display device in which the shield electrode is arranged between the data line and the pixel electrode of the fifth exemplary embodiment shown in FIG. 9 can be used, and the driving method in each sub-frame period may be any one of the driving methods of the other exemplary embodiments.

[Ninth Exemplary Embodiment]

Figure 15:
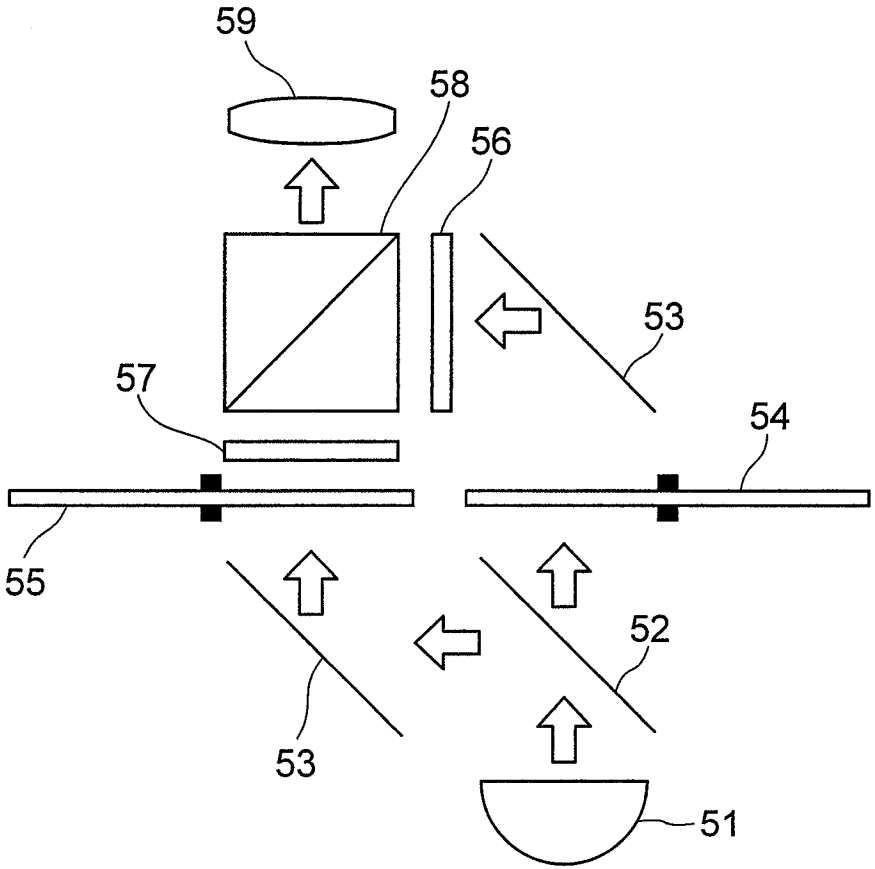
FIG. 15 is a block diagram showing a schematic configuration of a liquid crystal projector according to a ninth exemplary embodiment of the invention.

FIG. 15 shows a configuration example of a liquid crystal projector using each embodiment of the liquid crystal display device described above.

This liquid crystal projector is configured with: a light source lamp 51; a color separating mirror 52; a plurality of mirrors 53; two color wheels 54, 55; a liquid crystal display device 56 for G; a liquid crystal display device 57 for R and B; a synthesizing prism 58; and a projection lens 59. The color separating mirror 52 has a function of transmitting only the light of green wave range and reflecting the light of other wave ranges. It is not essential for the color separating mirror 52 to be configured with a single mirror but may be configured with a plurality of color separating mirrors and a mirror or with a color filter and a mirror, for example.

Figure 16:
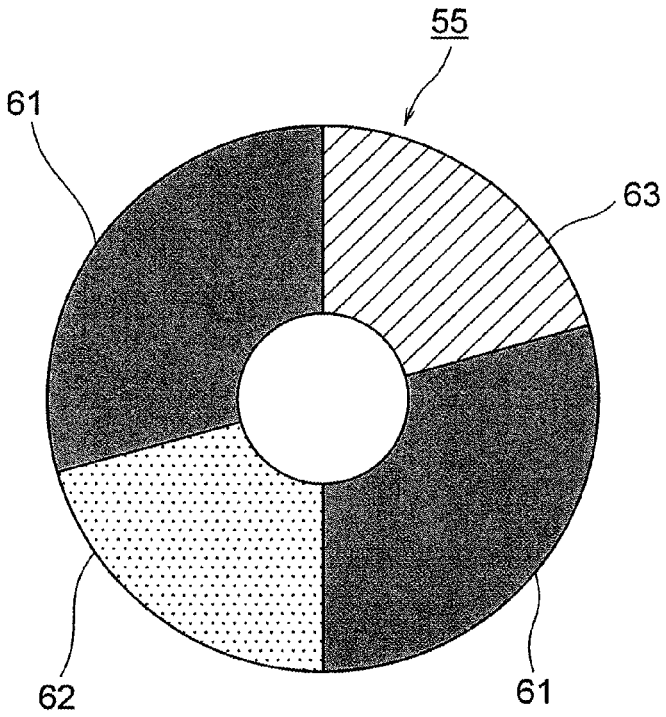
FIG. 16 is an explanatory view showing an outline of a configuration of a color wheel used in the ninth exemplary embodiment of the invention.
Figure 17:
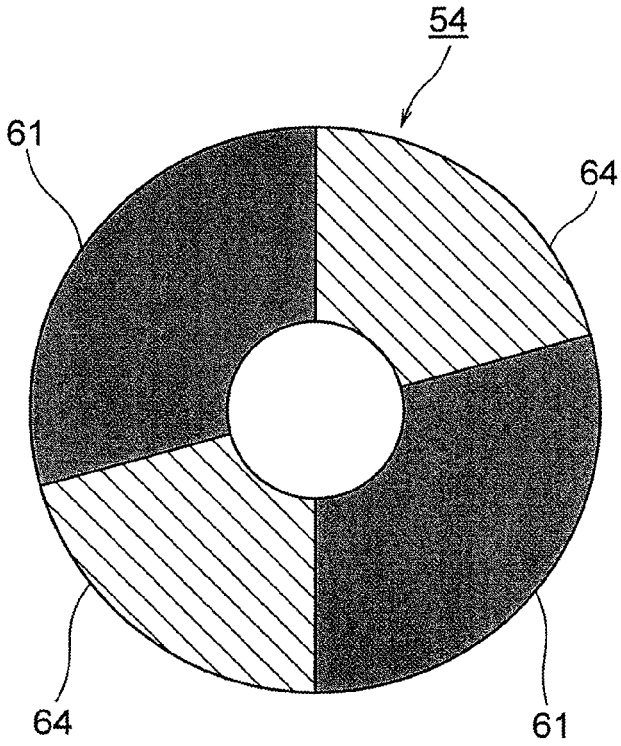
FIG. 17 is a view showing an outline of a configuration of another color wheel used in the ninth exemplary embodiment of the invention.

As shown in FIG. 16 and FIG. 17, the color wheels 54 and 55 used herein are: the color wheel 55 for R and B in which an R filter 62 that transmits the light of red wave range, a B filter 63 that transmits the light of blue wave range, and a shield filter 61 for shielding the light are arranged in a doughnut-like disk form; and the color wheel 54 for G in which two G filters 64 that transmit the light of green wave range and two shield filter 61 for shielding the light are arranged in a doughnut-like disk form. For the G filter 64 of the color wheel 54 for G, a color filter that transmits the light of wave range other than that of green may be used as well.

The synthesizing prism 58 is configured by combining a plurality of prisms, which has a function of synthesizing the light that makes incident on two planes and outputting the synthesized light from another plane. Instead of the synthesizing prism 58, an optical system having an equivalent function may also be used.

The configurations of the liquid crystal display device 56 for G and the liquid crystal display device 57 for R and B are the same as the liquid crystal display device of the first exemplary embodiment of the present invention shown in FIG. 1, and any of the configurations and the driving methods of the first to the sixth exemplary embodiments may be adopted.

The action of the ninth exemplary embodiment will now be described.

White light emitted from the light source lamp 51 is separated by the color separating mirror 52 into light of green wave range and light of other wave ranges. The G light of the green range is irradiated to the liquid crystal display device 56 for G via the G color wheel 54, the halfway mirror 53, and the like, and the transmitted light makes incident on the synthesizing prism 58.

The light of other wave ranges than green makes incident on the color wheel 55 for R, B via the halfway mirror 53 and the like, and the transmitted light is irradiated to the liquid crystal display device 57 for R, B. The light transmitted through the liquid crystal display device 57 for R and B makes incident on the synthesizing prism 58, and it is synthesized with the light transmitted through the liquid crystal display device 56 for G, and the synthesized light is enlarged and projected on a screen through the projection lens 59.

Figure 18:
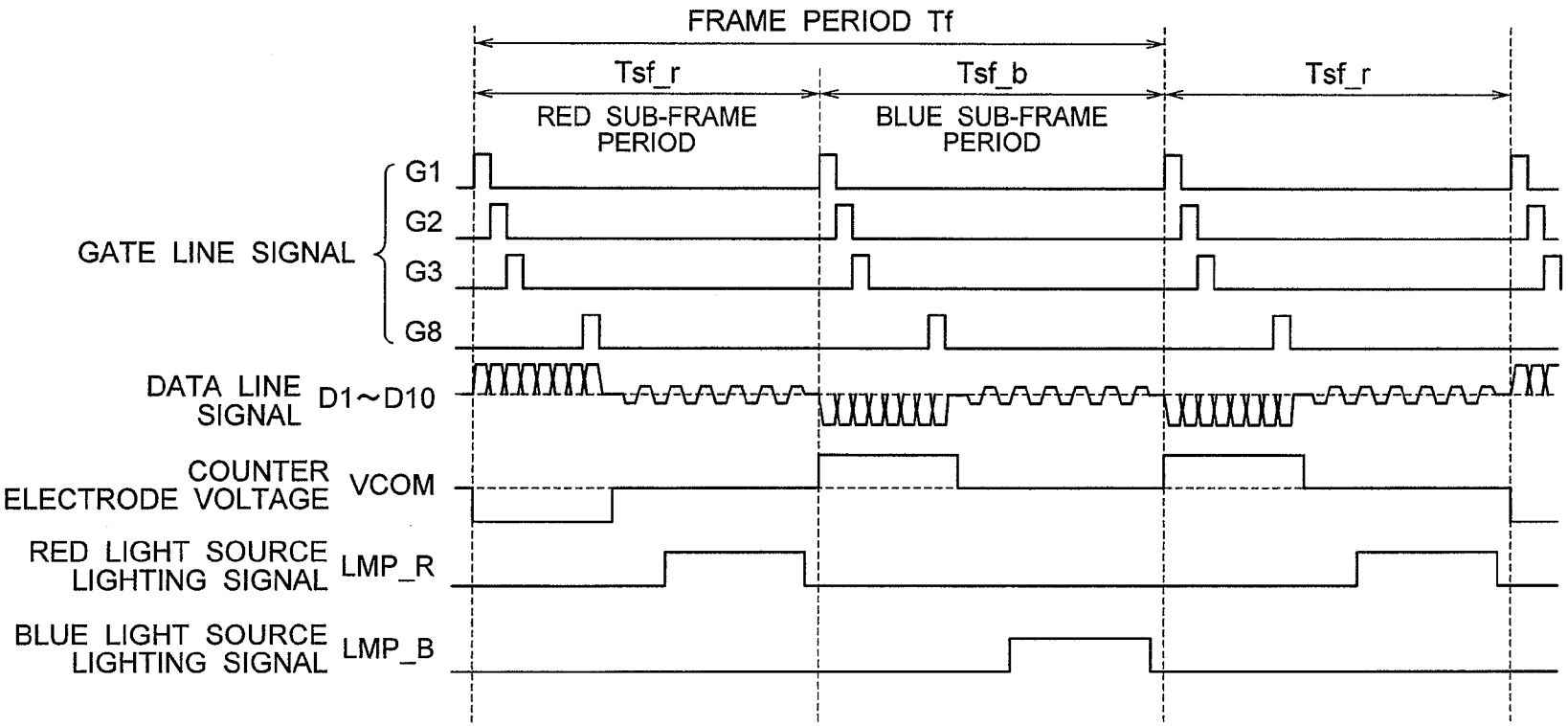
FIG. 18 is a timing chart showing a driving method of each R and B pixel portion of the liquid crystal display device according to the ninth exemplary embodiment of the invention.
Figure 19:
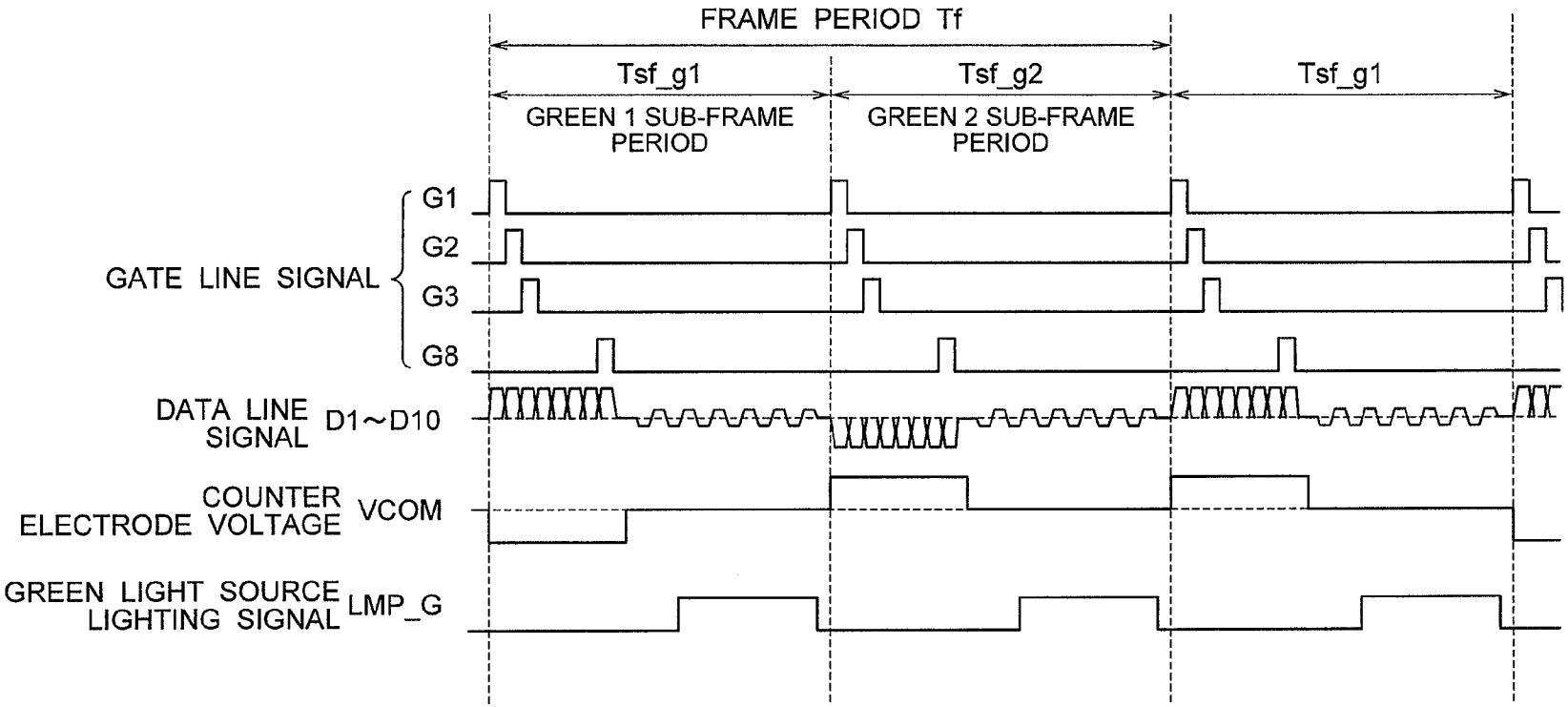
FIG. 19 is a timing chart showing a driving method of the G pixel portion of the liquid crystal display device according to the ninth exemplary embodiment of the invention.

FIG. 18 shows a timing chart of the liquid crystal display device 57 for R, B, and FIG. 19 shows a timing chart of the liquid crystal display device 56 for G.

First, actions of the liquid crystal display device 57 for R and B will be described by referring to FIG. 18. In the liquid crystal display device 57 for R and B, one frame period is divided into two sub-frame periods Tsf_r and Tsf_b.

In the sub-frame period Tsf_r, the gate driver circuit outputs a pulse to the gate lines G1-G8 for driving the pixel TFTs to be turned to ON state successively. The data driver circuit outputs a video signal of R to the data lines by synchronizing with the output of the gate driver circuit. Through these actions, the video signal is written successively to each pixel row along the gate lines. During a period where a control signal LMP_R becomes high level, which is after a certain period past from the time where the video signal is written to the last pixel row that is connected to the gate line G8, rotary action is controlled such that the R filter 62 of the color wheel 55 comes on an optical path that connects the mirror 53 and the liquid crystal display device 57 for R, B, so that the light of red wave range is irradiated to the liquid crystal display device 57. An R image that is the transmitted light therefrom is projected on a screen through the synthesizing prism 58 and the projection lens 59.

Similarly, a video signal of B is written successively to the liquid crystal display device 57 also in the sub-frame period Tsf_b, and rotary action is controlled such that the B filter 63 of the color wheel 55 comes on the optical path that connects the mirror 53 and the liquid crystal display device 57 for R, B during the period where the control signal LMP_B becomes high level. Thereby, an image of B can be obtained. This image B is also projected on the screen through the synthesizing prism 58 and the projection lens 59.

Meanwhile, with the liquid crystal display device 56 for G, one frame period is divided into two sub-frame periods Tsf_g1 and Tsf_g2 as shown in a timing chart in FIG. 19. A video signal of G is displayed on the liquid crystal display device 56 in each frame, and it is projected on the screen. Videos displayed in the two sub-frame periods Tsf_g1 and Tsf_g2 may be completely identical video signals or may be video signals that are changed according to a certain rule.

As an example of the certain rule, considered is a driving method which sets precision of inputted signals to be twice the precision that can be expressed originally by the liquid crystal display device 56 and, when displaying the luminance that is equal to or less than the minimum resolution of the liquid crystal display device 56, cancels the display in one of the sub-frame periods.

Through these actions, the number of gradations of G can be doubled. The timing for projecting the images of R, B and the timing for projecting the images of G may be completely the same or may be shifted from each other. The counter electrode potential VCOM and the shield electrode potential VSHD of the liquid crystal display device for R, B and the liquid crystal display device for G are both set as certain potentials. As the method for setting the potentials, any methods described along with the sectional structure of the liquid crystal device in the seventh-eleventh exemplary embodiments may be employed.

With the ninth exemplary embodiment, it becomes possible to reduce the size and the cost of the liquid crystal projector. The reason for this is that it is possible with this embodiment to configure a projector with two liquid crystal display devices, whereas three liquid crystal display devices are required conventionally.

[Tenth Exemplary Embodiment]

Figure 20:
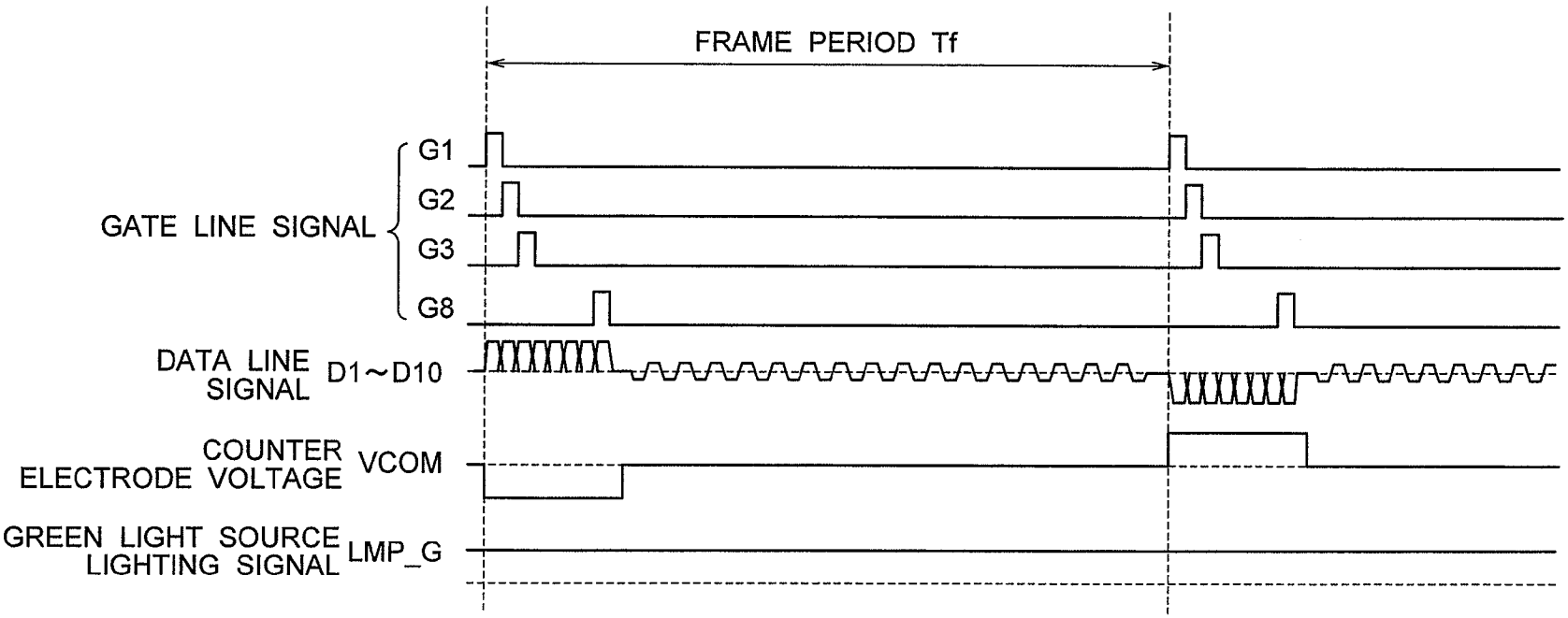
FIG. 20 is a timing chart showing another driving method of the G pixel portion of a liquid crystal display device according to a tenth exemplary embodiment of the invention.

FIG. 20 shows a timing chart showing another driving method of the liquid crystal display device for G of the liquid crystal projector that is shown in FIG. 15. With this driving method illustrated herein, the liquid crystal display device for G displays an image of G only once in a single frame period. Further, the light of green (G) wave range is irradiated to the liquid crystal display device constantly in one frame. Therefore, it is unnecessary to provide the color wheel for G that is illustrated in the configuration of the liquid crystal projector shown in FIG. 15.

With this liquid crystal projector, the size and the cost of the device can be reduced, since it becomes possible to configure the projector with two liquid crystal display devices, whereas three liquid crystal display devices are required conventionally. Further, it is because the color wheel for G becomes unnecessary.

[Eleventh Exemplary Embodiment]

Figure 21:
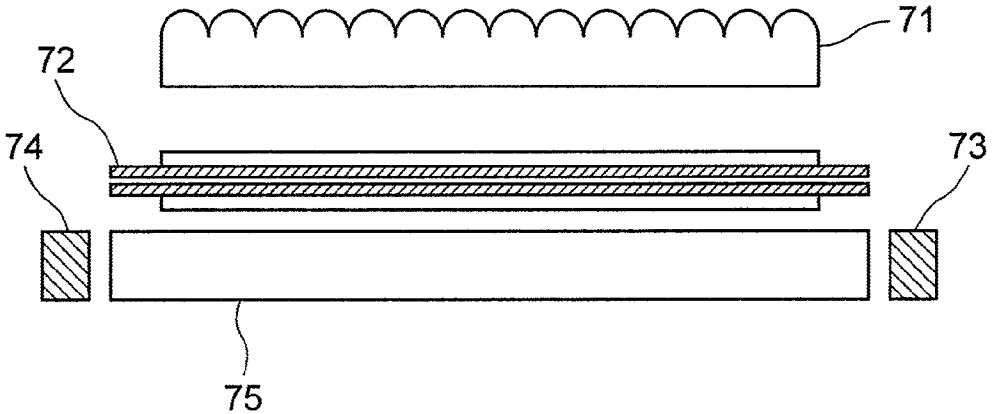
FIG. 21 is a block diagram showing a schematic configuration of a display for a three-dimensional image display according to an eleventh exemplary embodiment of the invention.

FIG. 21 shows an eleventh exemplary embodiment of the present invention, where a block diagram of a three-dimensional display for displaying a three-dimensional image configured using the liquid crystal display device of the present invention is shown.

This display includes a backlight 75 that is capable of controlling the light-up period separately for the left and right sides, a display device main body 72, a lens array 71, light sources 73, 74 on the left and right sides and, even though not shown, a control circuit for driving the liquid crystal display device and the backlight, and a power supply.

The angles of the light emitted from the backlight (lighting device) 75 vary depending on which of the two light sources (the light source 73 or the light source 74) is lighted up.

Figure 22:
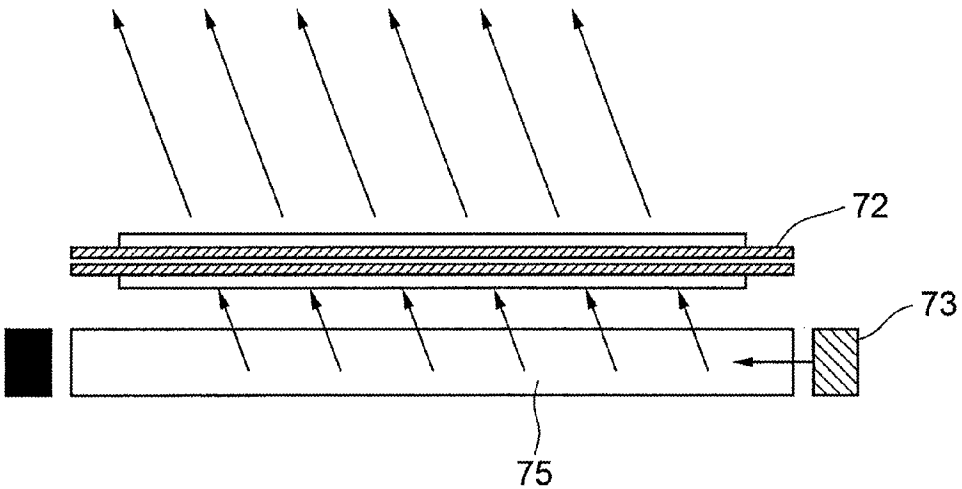
FIG. 22 is an explanatory view showing an action of a backlight used in the eleventh exemplary embodiment of the invention.
Figure 23:
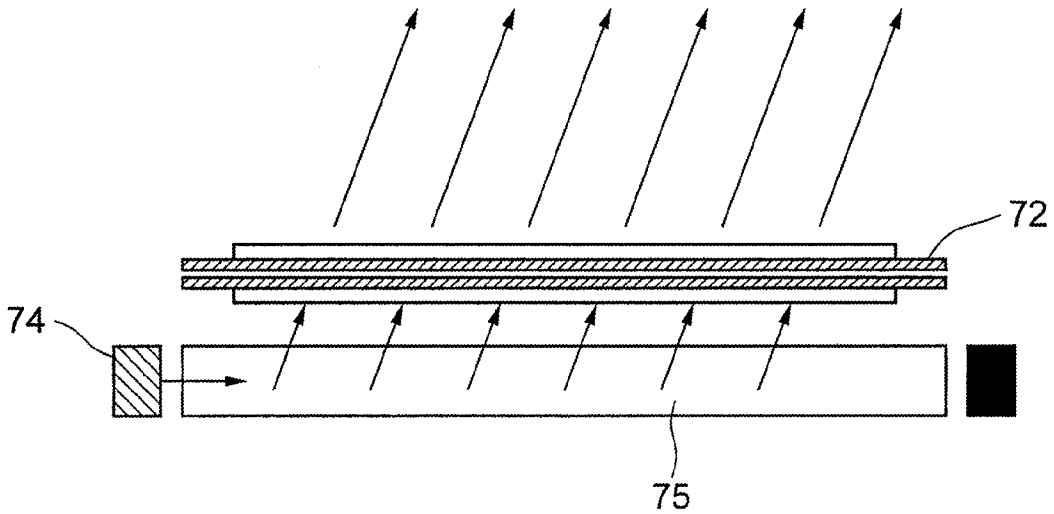
FIG. 23 is an explanatory view showing an action of another backlight used in the eleventh exemplary embodiment of the invention.

FIG. 22 and FIG. 23 are illustrations respectively showing the irradiation directions of the light when the light source 73 and the light source 74 are lighted up. For example, when the left light source 73 is lighted up as in FIG. 22, the light emitted therefrom turns out to be parallel light rays that are tilted to the left with respect to a perpendicular line for the top face of the backlight 75. Similarly, when the right light source 74 is lighted up as in FIG. 23, the light emitted therefrom turns out to be parallel light rays that are tilted to the right with respect to the perpendicular line. Such lights are transmitted through the display device main body 72, passed through the lens array 71, and reach the left eye and the right eye of the observer, respectively. The right-and-left light sources (74 and 73) are configured by three light sources corresponding to three primary colors of the lights of R, G, and B, each of which being capable of independently controlling the light-up period.

The backlight 75 is a lighting device for irradiating a light having high directivity in two different directions to the display panel under the control of the control part 22. The backlight 75 irradiates the light emitted towards one of two different directions to a first observing position by transmitting through the pixels, and irradiates the light emitted towards the other direction to a second observing position by transmitting through the pixels. The control part 22 displays an image for the first observing position or an image for the second observing position in accordance with the directions of the irradiated light, through outputting an instruction to the lighting device to irradiate the light emitted towards the two different directions alternately for every continuous two sub-frame periods.

Thereby, the images that are different from each other are displayed for the first observing position and the second observing position. Further, by setting the first observing position and the second observing position for the positions of the left eye and the right eye of an observer, it becomes possible to display a three-dimensional image through displaying the image for the right eye and the image for the left eye. Furthermore, each of the right-and-left light sources (74 and 73) is configured with three light sources that correspond to the primary colors of light, R, G, and B. Each of those light sources can control the light-up period individually.

Figure 24:
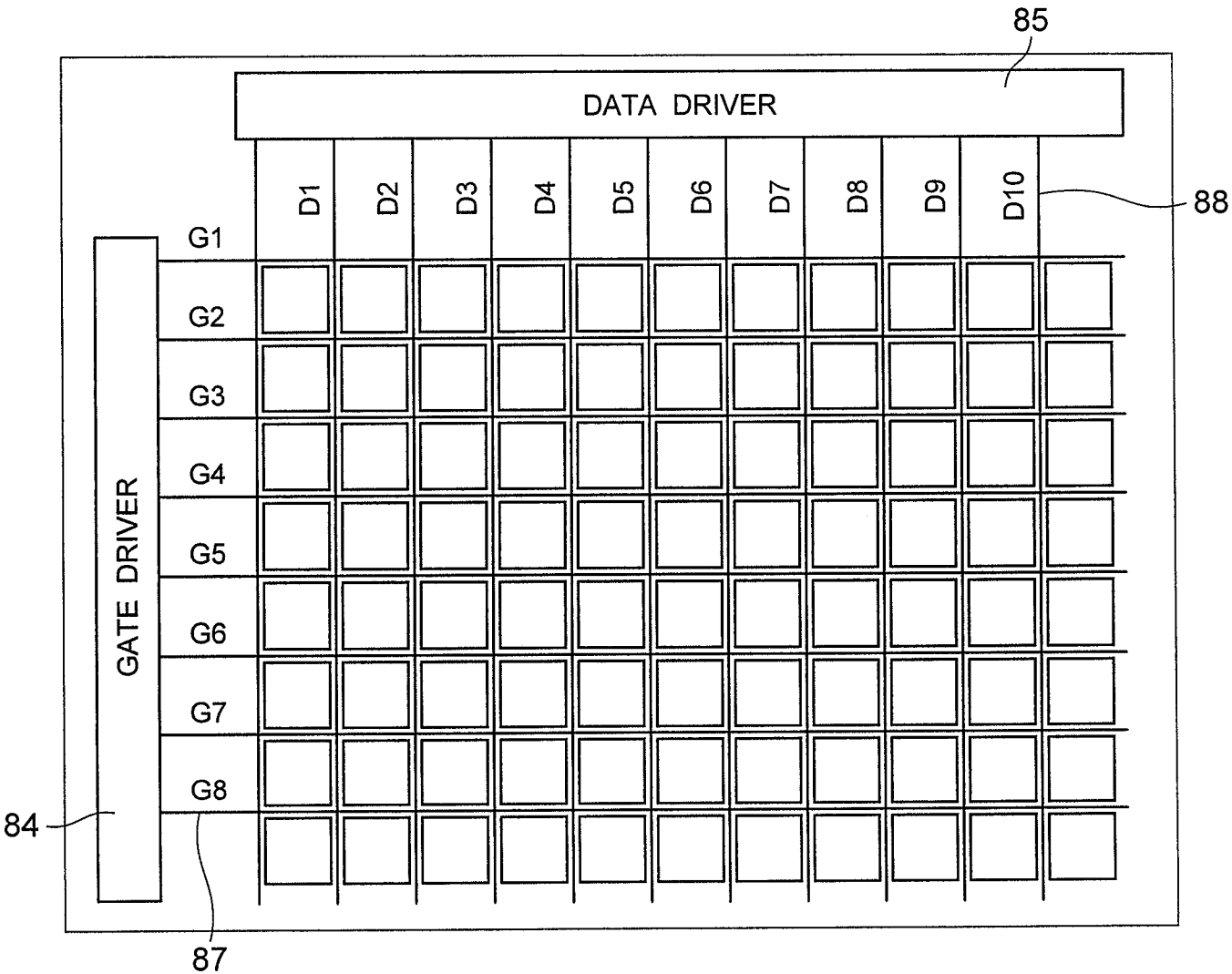
FIG. 24 is a plan view showing a configuration of a liquid crystal display device used in the eleventh exemplary embodiment of the invention.

FIG. 24 is a plan view showing a configuration of the display device body 72 used in the present display. The color filter is not arranged in the display device body 72, and each pixel is not divided into sub-pixels. Reference numeral 84 indicates the gate driver, reference numeral 85 indicates the data driver, reference numeral 87 indicates the gate line, and reference numeral 88 indicates the data line.

The configuration and the structure of the liquid crystal display device may be any of the first to the fifth exemplary embodiments of the present invention described above. Further, a material that is capable of high-speed action is used for the liquid crystal.

Figure 25:
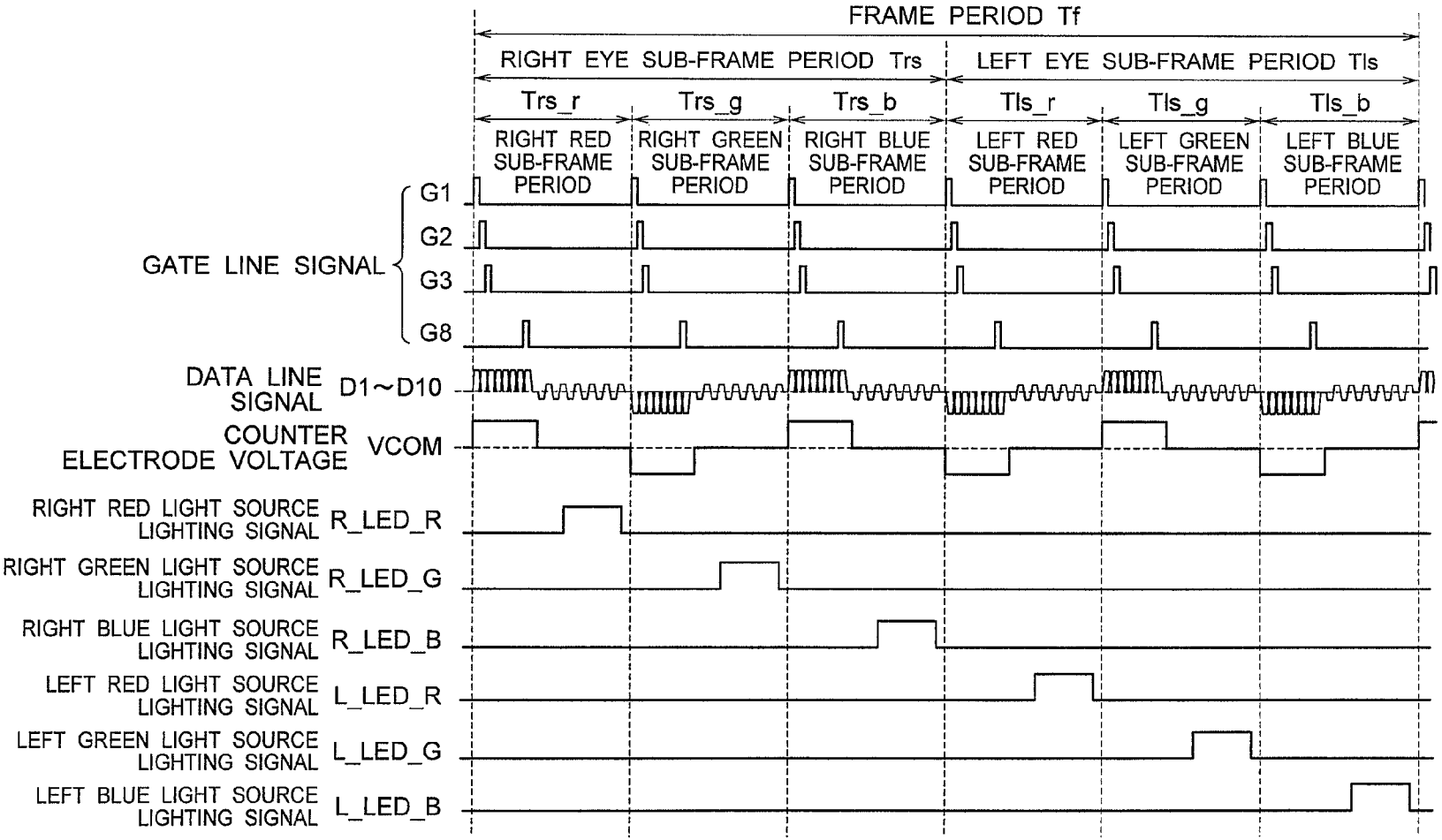
FIG. 25 is a timing showing a driving method of the liquid crystal display device used in the eleventh exemplary embodiment of the invention.

FIG. 25 is a timing chart showing the actions of the liquid crystal display device shown in FIG. 21. Tf in the drawing indicates a frame period where a three-dimensional image for one screen is displayed.

In this liquid crystal display panel, this frame period Tf is divided into two sub-frame periods Trs and Tls. Trs is a sub-frame period where an image that reaches the right eye is displayed, and Tls is a sub-frame period where an image that reaches the left eye is displayed.

Each sub-frame is further divided into three periods. The sub-frame Trs is divided into Trs_r, Trs_g, Trs_b, and the sub-frame Tls is divided into Tls_r, Tls_g, Tls_b. Actions in each of the periods Trs_r, Trs_g, Trs_b, Tls_r, Tls_g, and Tls_b may be executed by any one of the methods described in the first-eighth exemplary embodiments, and a three-dimensional image can be displayed thereby. In the drawing, R_LED_R shows the period where the light source (of the right light source) emitting the light of red wave range is lighted up. Similarly, R_LED_G shows the period where the light source (of the right light source) emitting the light of green wave range is lighted up, and R_LED_B indicates the period where the light source (of the right light source) emitting the light of blue wave range is lighted up. Meanwhile, L_LED_R, L_LED_G, and L_LED_B show the periods where the light sources (of the left light source) emitting the light of red wave range, the light of green wave range, and the light of blue wave range are lighted up, respectively.

With this exemplary embodiment of the invention, it is possible to display a color three-dimensional image to be bright with fewer flickers. It is because no color filter is used in the liquid crystal display device that is employed for this exemplary embodiment of the invention. Thus, it is unnecessary to divide the pixels into three sub-pixels, so that the light of the backlight can be utilized efficiently. Furthermore, it is unnecessary to divide the pixels for displaying the image for the right eye and the image for the left eye. Therefore, it is possible to provide a larger numerical aperture for transmitting the light when fabricating a liquid crystal display device including the same display area. Thus, a brighter image can be obtained. The reasons for enabling the flickers to be reduced are the same as those described above in the first-eighth exemplary embodiments.

[Twelfth Exemplary Embodiment]

Figure 26:
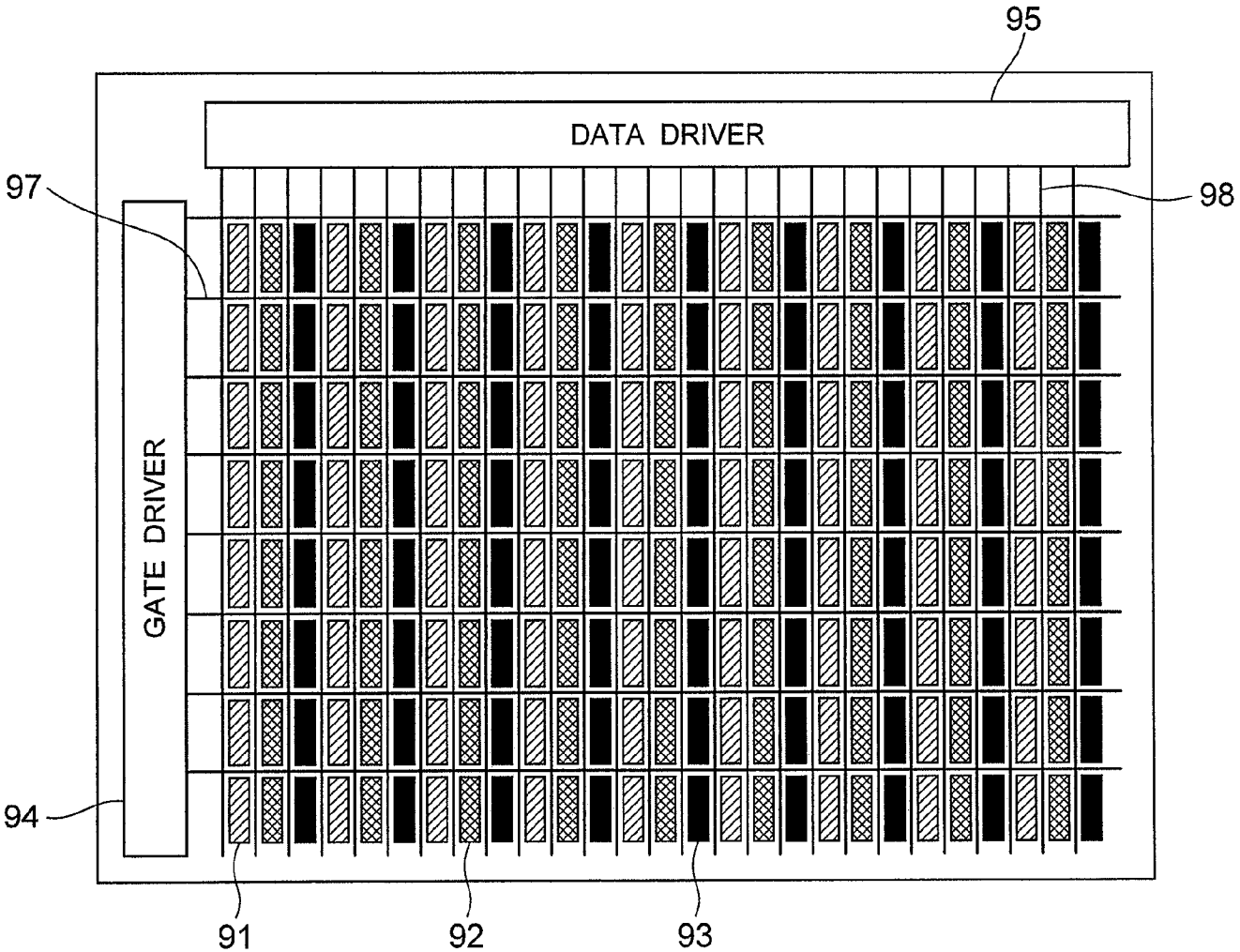
FIG. 26 is a plan view showing a configuration of a liquid crystal display device used in a display for a three-dimensional display according to a twelfth exemplary embodiment of the invention.
Figure 27:
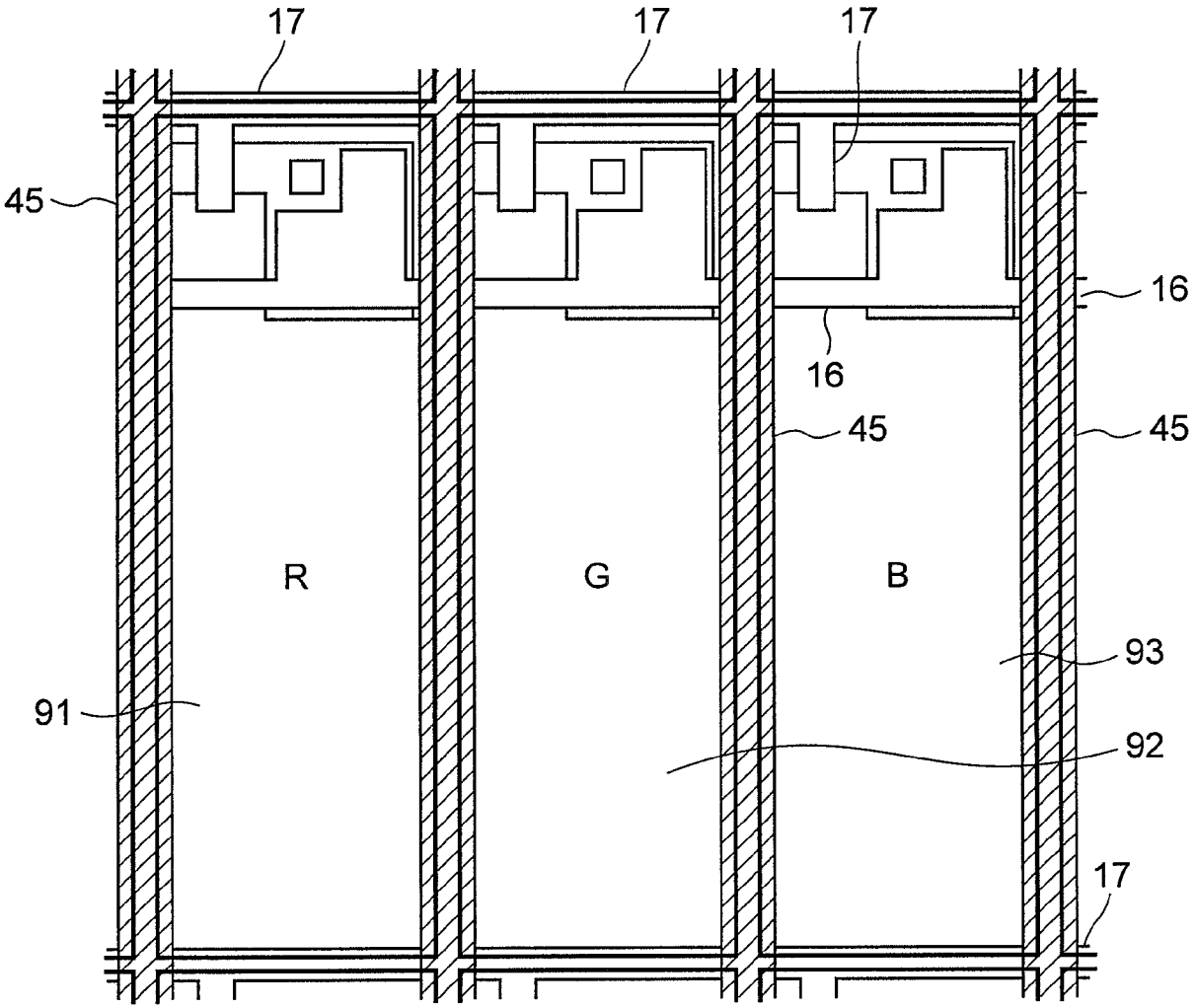
FIG. 27 is an explanatory view showing a layout of one pixel of the liquid crystal display device used in the twelfth exemplary embodiment of the invention.

FIG. 26 shows another structure of the liquid crystal display device used in a three-dimensional display that is shown in FIG. 21. As shown in FIG. 27, in this liquid crystal display device, each pixel is divided into three sub-pixels of R, G, and B. Therefore, light sources that emit white light are used for the right-and-left light sources of the backlight.

Figure 28:
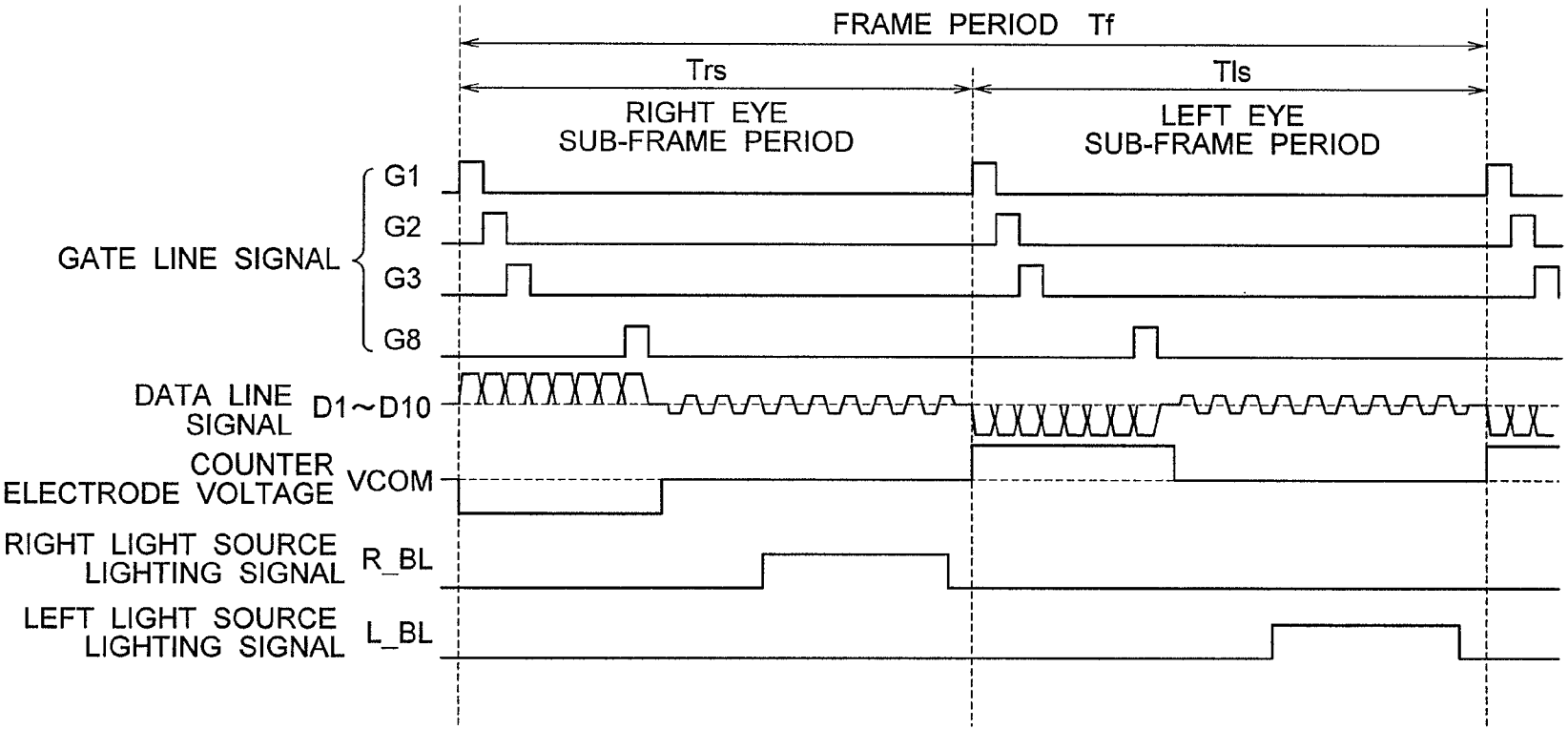
FIG. 28 is a timing showing a driving method of the liquid crystal display device used in the twelfth exemplary embodiment of the invention.
Figure 29:
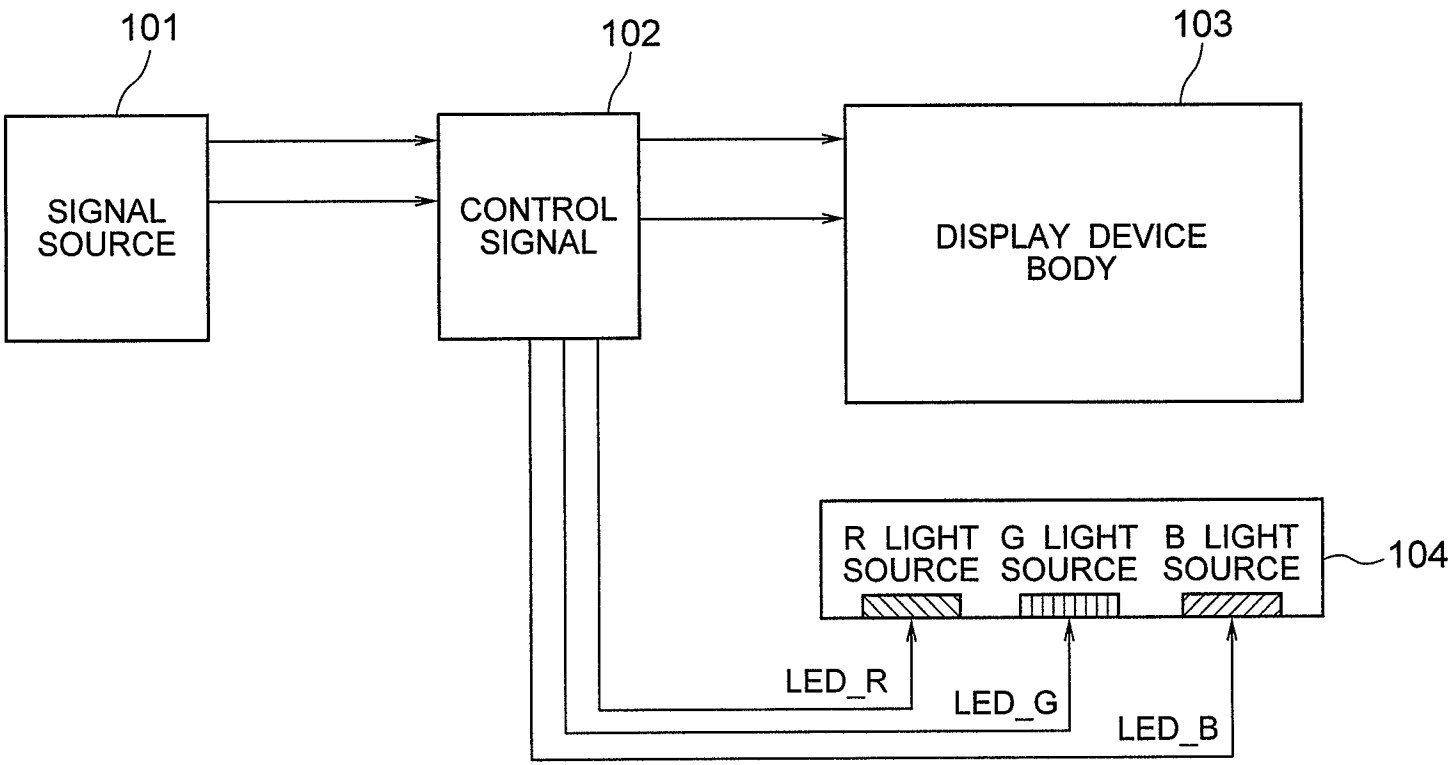
FIG. 29 is a block diagram showing a configuration of the liquid crystal display device pertaining to the related art.
Figure 30:
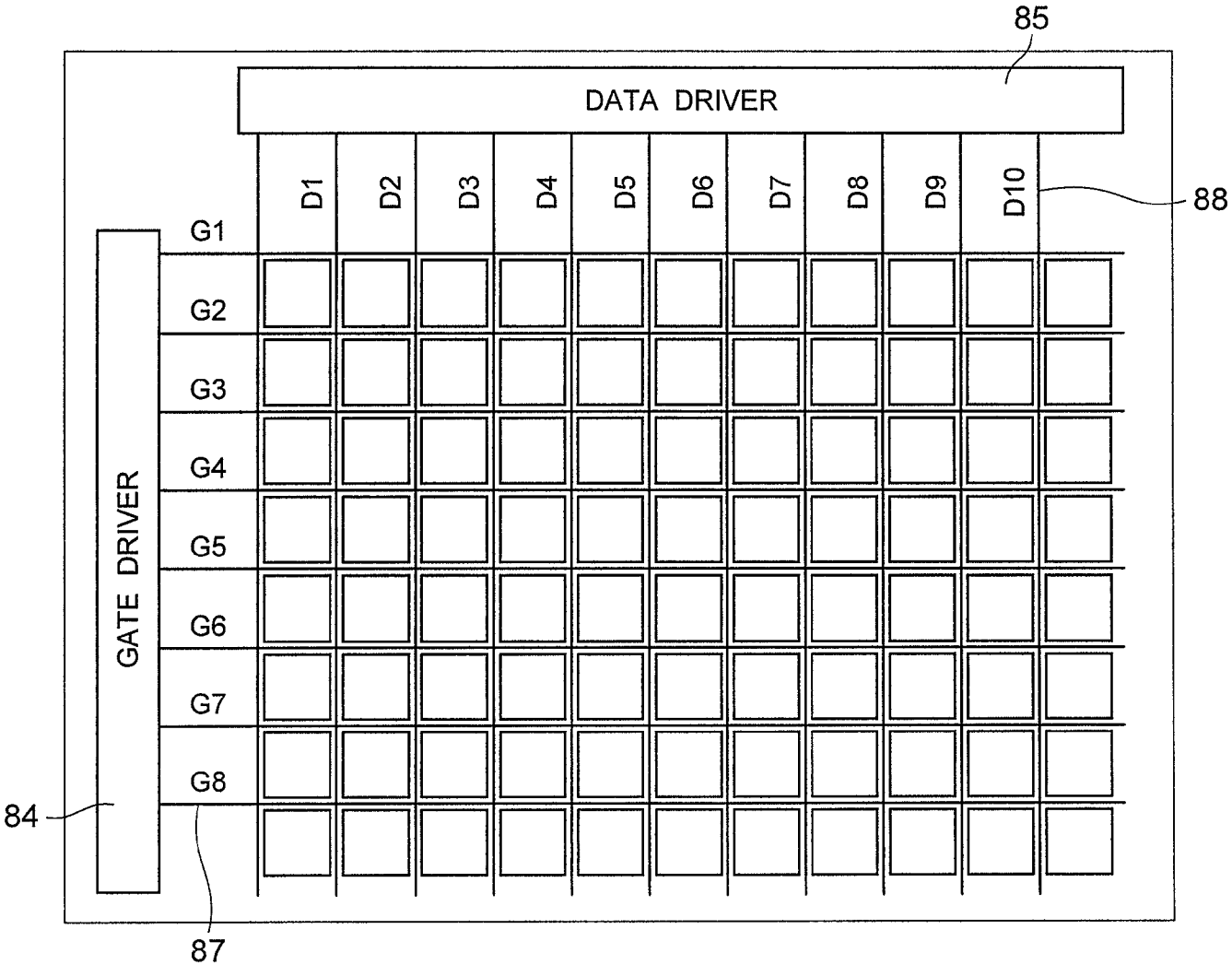
FIG. 30 is a plan view showing a configuration of the liquid crystal display device shown in FIG. 29.
Figure 31:
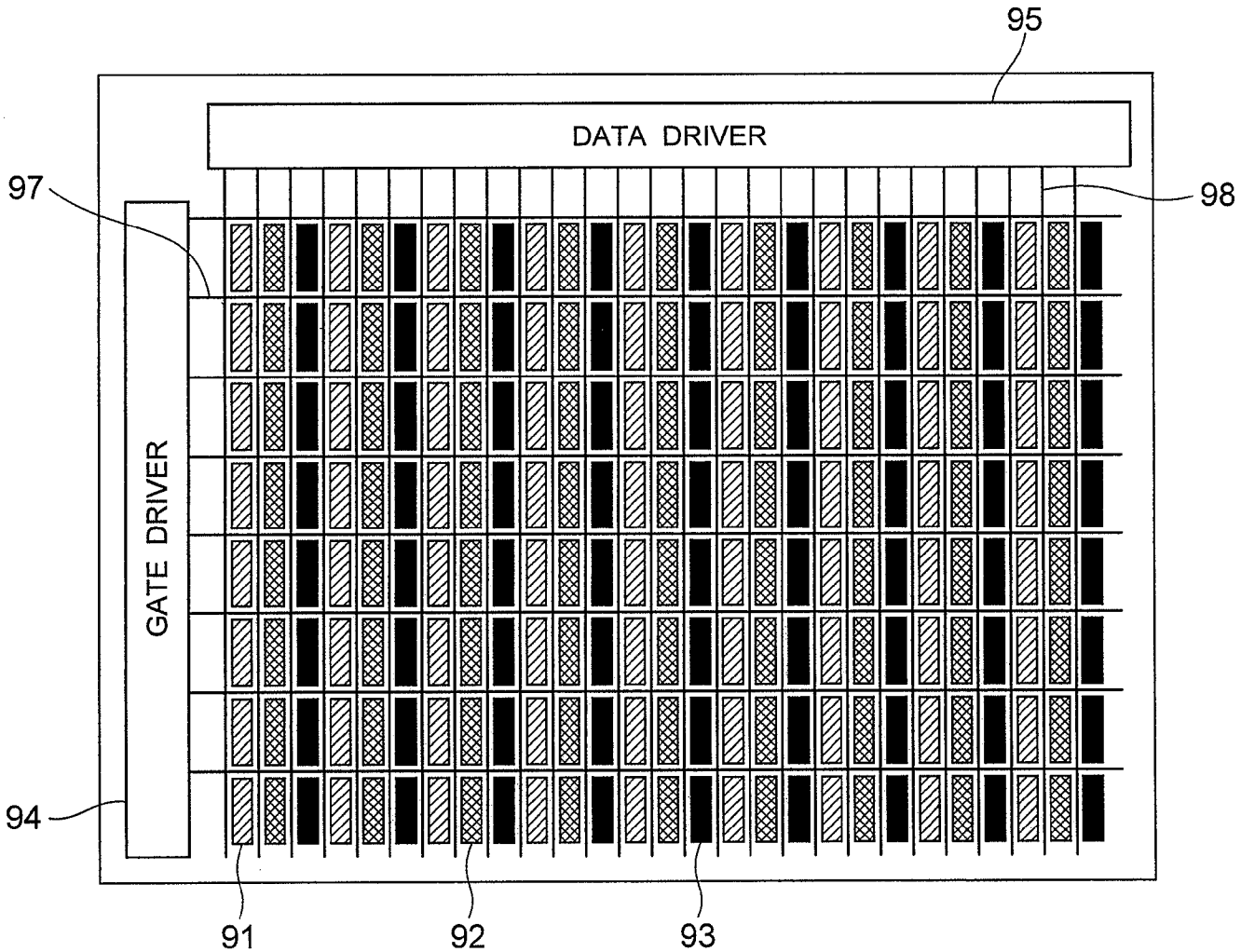
FIG. 31 is a plan view showing a configuration of the liquid crystal display device which performs color displays by using the color filters in the related art.
Figure 32:
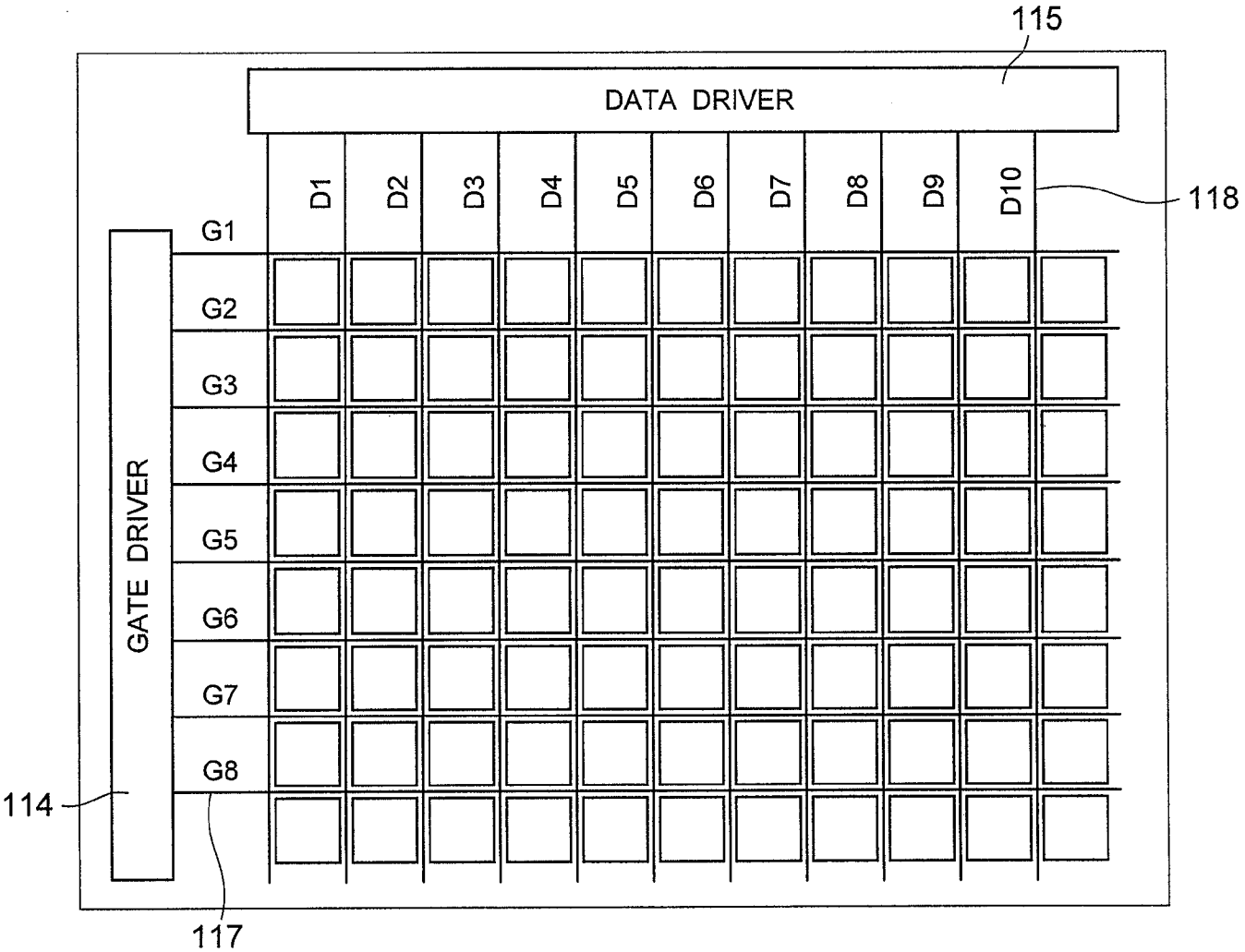
FIG. 32 is a plan view showing a configuration of the liquid crystal display device shown in FIG. 29.
Figure 33:
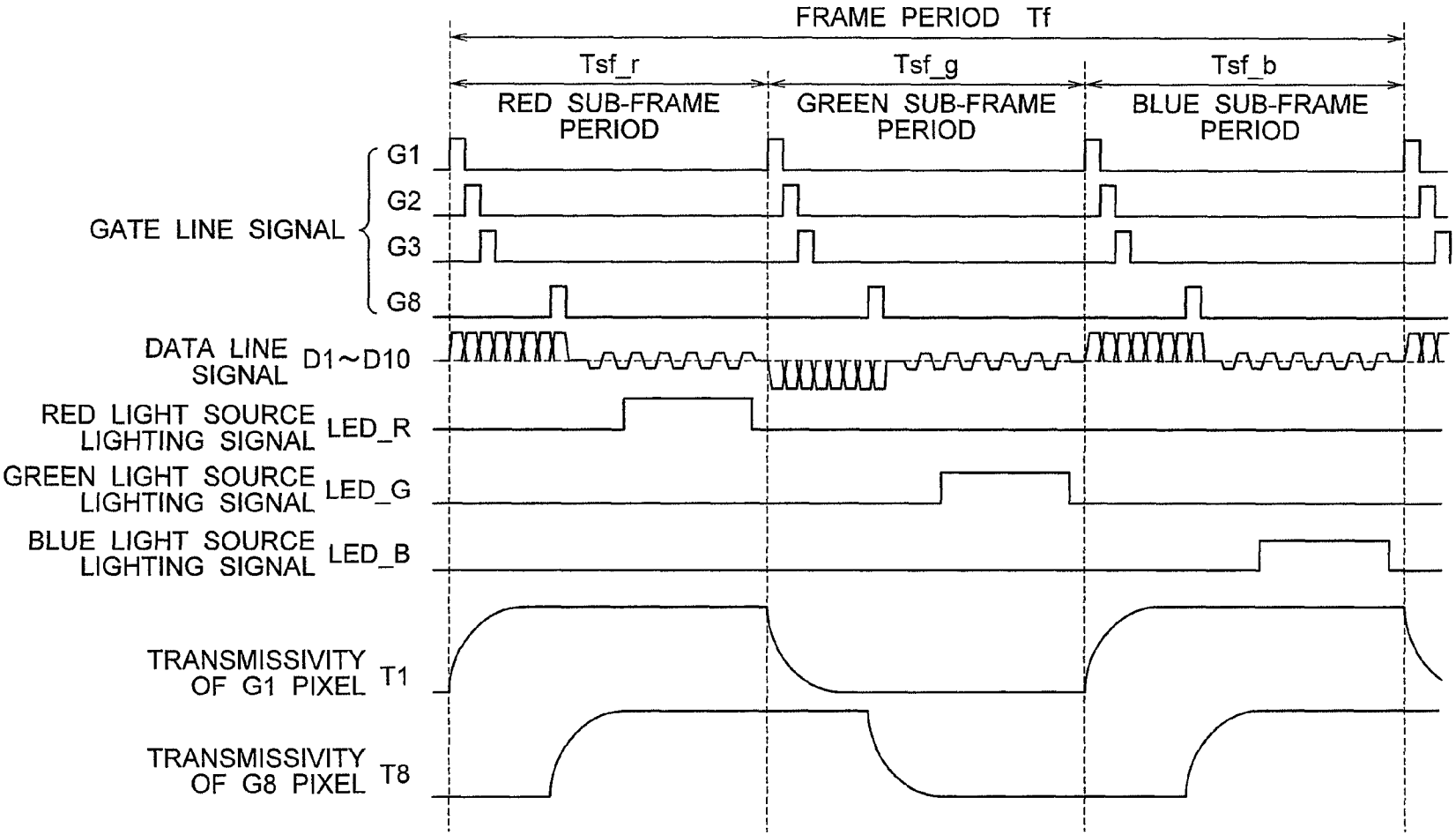
FIG. 33 is a timing chart showing a driving method of the liquid crystal display device shown in FIG. 29.

FIG. 28 shows a timing chart of the liquid crystal display device of the twelfth exemplary embodiment. One frame period Tf where a three-dimensional image for one screen is displayed is divided into two sub-frame periods Trs and Tls, and an image for the right eye and an image for the left eye are displayed in each of the sub-frame periods. The period for lighting up the right light source is shown with a high-level period of R_BL, and light-up is started after passage of a certain time from the point when writing of the image for the right eyes is completed. Similarly, the period for lighting up the left light source is shown with a high-level period of L_BL.

As a configuration and a structure of the liquid crystal display device, any of the above-described first to fifth exemplary embodiments of the invention can be employed. Further, the correction voltage, the counter electrode potential VCOM, the shield electrode potential VSHD, and the video signal potential may be set in accordance with the structure, and the device may be operated by any one of the methods described above in the first-eighth exemplary embodiments. Furthermore, a material that is capable of high-speed response is used for the liquid crystal.

With this exemplary embodiment of the invention, it is possible to display a color three-dimensional image to be bright with fewer flickers. The reason for this is that it is unnecessary with the liquid crystal display device used in this exemplary embodiment to divide the pixels for displaying the image for the right eye and the image for the left eye. Therefore, it is possible to provide a larger numerical aperture for transmitting the light when fabricating a liquid crystal display device including the same display area. Thus, a brighter image can be obtained. The reasons for enabling the flickers to be reduced are the same as those described above in each of the first-eighth exemplary embodiments.

In addition, with the exemplary embodiment of the invention, it is possible to use the liquid crystal display device described in each of the exemplary embodiments for portable terminal devices. This makes it possible to achieve a portable terminal device with a bright display luminance having fewer flickers on a display part.

In the above, the liquid crystal display device of the exemplary embodiments of the invention as well as the driving methods employed therein are described. However, the contents executed in each step of the above-described driving methods may be formed into programs to be executed by a computer of the control part. This makes it possible with the computer to achieve such propositions to reduce flickers even when a liquid material capable of high-speed response is used, and to increase the display luminance.

With the embodiments of the invention, it is possible to reduce flickers dramatically even when a liquid crystal material of high response speed is used for the liquid crystal display device. Flickers as the issue of the liquid crystal display device that uses a material of high response speed for the liquid crystal are generated because a potential fluctuation of the data line generates a potential fluctuation of the pixel electrode when the pixel electrode and the data line are coupled due to the parasitic capacitance. A shield electrode layer is provided under the pixel electrode via an insulating film in the liquid crystal display device of the present invention, so that the parasitic capacitance of the pixel electrode and the data line or the like can be reduced to be extremely small. Thereby, the flickers can be reduced dramatically.

Furthermore, with a liquid crystal display device according to another exemplary embodiment of the invention, it is possible to forcibly cause a potential fluctuation in the pixel electrode by the parasitic capacitance and to control the potential fluctuation to become almost equal between each of the sub-frames through inputting a waveform of a correction voltage signal having a frequency of more than a certain level to the data line after writing a video signal to all the pixels in each sub-frame period. Therefore, luminance changes caused due to the potential fluctuations of the pixel electrode generated in each sub-frame can be made uniform, so that the flickers can be reduced dramatically.

Further, with the exemplary embodiment of the invention, it is possible to improve the display luminance of the field sequential type liquid crystal display device. With the field sequential type, the amount of light required for achieving a proper white balance becomes larger in order of G, R, B. Thus, in field sequential drive, it is effective to display more images of G than images of others for improving the luminance. However, when the number of sub-frames is increased, each sub-frame period becomes shorter, thereby requiring a liquid crystal material that is capable of responding at still higher speed. As described above, however, when the response speed of the liquid crystal becomes fast, flickers are to be generated. Since it is possible with the exemplary embodiment of the invention to reduce the flickers even when a material of high response speed is used, the driving method employing a large number of sub-frames can be used. Therefore, a bright image with fewer flickers can be obtained.

Further, with the exemplary embodiment of the invention, it becomes possible to reduce the size and the cost of the liquid crystal projector. With the exemplary embodiment of the invention, images with fewer flickers can be obtained even when the field sequential system is used for the liquid crystal display device. Therefore, it is possible to configure a projector with two liquid crystal display devices, whereas three liquid crystal display devices are required conventionally. Thereby, the size and the cost of the liquid crystal display device can be reduced. Furthermore, it is possible with the exemplary embodiment of the invention to display three-dimensional color images to be bright with fewer flickers.

Even when the field sequential type is employed for the liquid crystal display device used in the exemplary embodiment of the invention, images with fewer flickers can be obtained. Thus, it is unnecessary to provide the color filter. Therefore, it is unnecessary to divide each pixel into three sub-pixels, so that the light of the backlight can be utilized efficiently. Furthermore, it is unnecessary to divide the pixels for displaying the image for the right eye and the image for the left eye. Therefore, it is possible to provide a larger numerical aperture for transmitting the light when fabricating a liquid crystal display device including the same display area. Thus, a brighter image can be obtained.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

Industrial Applicability

As described above, it is possible with the present invention to achieve the liquid crystal display device having a bright screen with fewer flickers. Therefore, the present invention can be applied broadly to wide ranges of industrial fields that use liquid crystal display devices, such as TV sets, image pick-up devices, portable terminals, projectors, etc., and its applicability is high.

What is claimed is:

1. A liquid crystal display device comprising:

a display panel including a pixel matrix in which pixels each including at least a switching element and a pixel electrode are arranged in matrix near intersection points of data lines and gate lines arranged longitudinally and laterally, and a counter electrode that is arranged to oppose the pixel matrix with a liquid crystal layer interposed therebetween;

a light source for irradiating light onto the display panel; and a control part for dividing a frame period for displaying a video signal of one screen into a plurality of sub-frame periods and performing display on the display panel; wherein the control part divides each of the sub-frame periods into a writing period for writing the video signal to the pixel matrix and a display period for lighting up the light source, and, in the display period, renders all the switching elements non-conductive while simultaneously applying a correction voltage that is different from the video signal to the data line to allow the correction voltage to be applied to the switching elements, and the correction voltage is an alternating signal having a higher frequency than a frequency at which a liquid crystal molecule of the liquid crystal layer responds.

2. The liquid crystal display device according to claim 1, wherein a conductive layer separated with an insulation film is arranged between the pixel electrode and the data line; and the control part performs voltage control to the conductive layer.

3. The liquid crystal display device according to claim 2, wherein the control part changes a waveform of the voltage that is applied to the conductive layer for each of the sub-frame periods.

4. The liquid crystal display device according to claim 2, wherein the control part applies the voltage to the conductive layer, by changing the voltage depending on polarities of the video signals for the counter electrode.

5. The liquid crystal display device according to claim 1, wherein the light source comprises different colors, and the control part lights up the light source of different colors for each of the sub-frame periods, and performs a display control of a color image corresponding to the color of the light source.

6. The liquid crystal display device according to claim 1, further comprising a lighting device for irradiating, to the display panel, light of high directivity in two different directions, under the control of the control part.

7. The liquid crystal display device according to claim 6, wherein the lighting device irradiates the light emitted towards one of the two different directions to a first observing position by transmitting the pixels, and irradiates the light emitted towards the other one of the directions to a second observing position by transmitting the pixels; and the control part displays an image for the first observing position or an image for the second observing position in accordance with the directions of the irradiated light through outputting an instruction to the lighting device to irradiate the light emitted towards the two different directions alternately for every continuous two sub-frame periods.

8. The liquid crystal display device according to claim 6, wherein the lighting device irradiates the light emitted towards one of the two different directions to the right eye of an observer by transmitting the pixels, and irradiates the light emitted towards the other one of the directions to the left eye of the observer by transmitting the pixels; and the control part displays an image for a right eye or an image for a left eye in accordance with the directions of the irradiated light through outputting an instruction to the lighting device to irradiate the light emitted towards the two different directions alternately for every continuous two sub-frame periods.

9. A control system for drive controlling a display panel including: a pixel matrix in which pixels each including at least a switching element and a pixel electrode are arranged in matrix near intersection points of data lines and gate lines arranged longitudinally and laterally, and a counter electrode that is arranged to oppose the pixel matrix with a liquid crystal layer interposed therebetween, the control system comprising:

a light source for irradiating light onto the display panel; and a control part for dividing a frame period for displaying a video signal of one screen into a plurality of sub-frame periods and performing display on the display panel; wherein the control part divides each of the sub-frame periods into a writing period for writing the video signal to the pixel matrix and a display period for lighting up the light source, and, in the display period, renders all the switching elements non-conductive while simultaneously applying a correction voltage that is different from the video signal to the data line to allow the correction voltage to be applied to the switching elements, and the correction voltage is an alternating signal having a higher frequency than a frequency at which a liquid crystal molecule of the liquid crystal layer responds.

10. The control system according to claim 9, wherein the control part performs voltage control to a conductive layer arranged between the pixel electrode and the data line while being separated with an insulation film.

11. The control system according to claim 10, wherein the control part changes a waveform of the voltage that is applied to the conductive layer for each of the sub-frame periods.

12. The control system according to claim 10, wherein the control part applies the voltage to the conductive layer, by changing the voltage depending on polarities of the video signals for the counter electrode.

13. The control system according to claim 9, wherein the light source comprises different colors, and the control part lights up the light source of different colors for each of the sub-frame periods, and performs a display control of a color image corresponding to the color of the light source.

14. The control system according to claim 9, further comprising a lighting device for irradiating, to the display panel, light of high directivity in two different directions, under the control of the control part.

15. The control system according to claim 14, wherein the lighting device irradiates the light emitted towards one of the two different directions to a first observing position by transmitting the pixels, and irradiates the light emitted towards the other one of the directions to a second observing position by transmitting the pixels; and the control part displays an image for the first observing position or an image for the second observing position in accordance with the directions of the irradiated light through outputting an instruction to the lighting device to irradiate the light emitted towards the two different directions alternately for every continuous two sub-frame periods.

16. The control system according to claim 14, wherein the lighting device irradiates the light emitted towards one of the two different directions to the right eye of an observer by transmitting the pixels, and irradiates the light emitted towards the other one of the directions to the left eye of the observer by transmitting the pixels; and the control part displays an image for a right eye or an image for a left eye in accordance with the directions of the irradiated light through outputting an instruction to the lighting device to irradiate the light emitted towards the two different directions alternately for every continuous two sub-frame periods.

17. A driving method for drive controlling a display panel including a pixel matrix in which pixels each including at least a switching element and a pixel electrode are arranged in matrix near intersection points of data lines and gate lines arranged longitudinally and laterally, and a counter electrode that is arranged to oppose the pixel matrix with a liquid crystal layer interposed therebetween, the method comprising:

dividing a frame period for displaying a video signal of one screen into a plurality of sub-frame periods and displaying images on the display panel; and dividing each of the sub-frame periods into a writing period for writing the video signal to the pixel matrix and a display period for lighting up a light source, and, in the display period, rendering all the switching elements non-conductive while simultaneously applying a correction voltage that is different from the video signal to the data line to allow the correction voltage to be applied to the switching elements, and the correction voltage is an alternating signal having a higher frequency than a frequency at which a liquid crystal molecule of the liquid crystal layer responds.

18. The driving method according to claim 17, further comprising performing voltage control to a conductive layer arranged between the pixel electrode and the data line.

19. The driving method according to claim 18, wherein a voltage waveform to be applied to the conductive layer is changed for each of the sub-frame periods.

20. The driving method according to claim 18, wherein a different voltage is applied depending on the-polarities of the video signals for the counter electrode.

21. A non-transitory computer readable medium having stored thereon a control program, for drive controlling a display panel including a pixel matrix in which pixels each including at least a switching element and a pixel electrode are arranged in matrix near intersection points of data lines and gate lines arranged longitudinally and laterally, and a counter electrode that is arranged to oppose the pixel matrix with a liquid crystal layer interposed there between; the control program causing a computer to execute functions of:

dividing a frame period for displaying a video signal of one screen into a plurality of sub-frame periods and displaying images on the display panel; and dividing each of the sub-frame periods into a writing period for writing the video signal to the pixel matrix and a display period for lighting up the light source, and, in the display period, rendering all the switching elements non-conductive while simultaneously applying a correction voltage that is different from the video signal to the data line to allow the correction voltage to be applied to the switching elements, and the correction voltage is an alternating signal having a higher frequency than a frequency at which a liquid crystal molecule of the liquid crystal layer responds.

* * * * *